US012396518B2

(12) United States Patent
Fromholtz et al.

(10) Patent No.: US 12,396,518 B2
(45) Date of Patent: Aug. 26, 2025

(54) CUSHIONING MEMBER

(71) Applicant: Scholl's Wellness Company LLC, Parsippany, NJ (US)

(72) Inventors: Alexander Fromholtz, Leonia, NJ (US); Daniel L. Miranda, Basking Ridge, NJ (US); Harold A. Howlett, Parsippany, NJ (US)

(73) Assignee: Scholl's Wellness Company LLC, Parsippany, NJ (US)

( * ) Notice: Subject to any disclaimer, the term of this patent is extended or adjusted under 35 U.S.C. 154(b) by 0 days.

(21) Appl. No.: 17/057,641

(22) PCT Filed: Jun. 14, 2019

(86) PCT No.: PCT/US2019/037287
§ 371 (c)(1),
(2) Date: Nov. 20, 2020

(87) PCT Pub. No.: WO2019/241693
PCT Pub. Date: Dec. 19, 2019

(65) Prior Publication Data

US 2021/0145122 A1 May 20, 2021

Related U.S. Application Data

(60) Provisional application No. 62/684,979, filed on Jun. 14, 2018.

(51) Int. Cl.
*A43B 17/14* (2006.01)
*A43B 17/00* (2006.01)

(52) U.S. Cl.
CPC ..... *A43B 17/14* (2013.01); *A43B 17/006* (2013.01)

(58) Field of Classification Search
CPC ..... A43B 17/006; A43B 17/14
See application file for complete search history.

(56) References Cited

U.S. PATENT DOCUMENTS 5,469,639 A * 11/1995 Sessa ..... A43B 13/181 36/28
10,188,172 B1 * 1/2019 Wurtz ..... A43B 7/144
(Continued)

FOREIGN PATENT DOCUMENTS

EP 1623643 A1 * 2/2006 ..... A43B 17/026
EP 3039979 A1 * 7/2016 ..... A43B 7/00
(Continued)

OTHER PUBLICATIONS

International Search Report for PCT/US2019/037287 mailed Sep. 30, 2019, 3 pages.

*Primary Examiner* — Megan E Lynch
(74) *Attorney, Agent, or Firm* — Lowenstein Sandler LLP

(57) ABSTRACT

A cushioning member that includes a base, a plurality of protrusions extending from at least a portion of the base, the protrusions being configured to deform to provide cushioning; and an outer surface at least partially formed from distal ends of the protrusions, wherein at least a portion of a first protrusions is taller than an adjacent portion of a second protrusions so that the portion of the first protrusions deforms prior to the adjacent portion of the second protrusions in response to a pressure applied by a planar surface in contact with the outer surface of the cushioning member.

17 Claims, 28 Drawing Sheets

(56) References Cited

U.S. PATENT DOCUMENTS

| | | | | |
|---|---|---|---|---|
| 2003/0024134 | A1* | 2/2003 | Howlett | A43B 13/181 36/43 |
| 2007/0022630 | A1* | 2/2007 | Lundy, Jr. | A43B 13/386 36/43 |
| 2013/0042502 | A1* | 2/2013 | Grisoni | A43B 7/142 36/43 |
| 2013/0104419 | A1* | 5/2013 | Horesh | A43B 7/141 36/43 |
| 2016/0128422 | A1* | 5/2016 | Gentry | A43B 17/003 36/44 |

FOREIGN PATENT DOCUMENTS

| | | | |
|---|---|---|---|
| EP | 3100627 | A1 | 12/2016 |
| WO | 2013184886 | A1 | 12/2013 |

* cited by examiner

| Durometers | 30 | 45 | 60 |
|---|---|---|---|
| Full Thickness Wave | 125 | 147.8 | 191.9333333 |
| Full Thickness Thin Dense Wave | 124.2333333 | 138.6666667 | 162.0333333 |
| Layered Wave | 127.9666667 | 147.0333333 | 177.2666667 |

| Durometers | 30 | 45 | 60 |
|---|---|---|---|
| Full Thickness Wave | 62.8 | 73.1 | 96.8 |
| Full Thickness Thin Dense Wave | 58.13333333 | 62.4 | 75.63333333 |
| Layered Wave | 63.16666667 | 71.3 | 84.4 |

CUSHIONING MEMBER

FIELD OF THE INVENTION

This invention relates generally to cushioning and, more specifically, to products having cushioning surfaces such as insoles.

BACKGROUND OF THE INVENTION

Insoles have generally been formed by a pad of cushioning material, such as foam or sponge rubber, that has a general shape conforming to the interior of a shoe. Wearers who desire additional shoe comfort or who suffer from foot trouble, such as plantar heel pain and arch pain, insert the cushioning insole into the shoe to provide added cushioning and support. Generally, cushioning insoles are designed to strike a balance between shock absorption and support. Shock absorption dissipates energy from a footfall, and results in a more cushioned feel for the wearer. However, due to the energy dissipation of shock absorption, walking and running can require more energy, causing the wearer's muscles to tire more easily. Insoles can be configured with materials that provide more energy rebound, which improves the walking and running performance but reduces the cushioning feel of the insole.

Determining the optimal material for use in an insole is a unique balancing act of maximum mechanical performance without sacrificing comfort. Rigid, elastic materials such as rubbers and high durometer gels can provide high energy rebound but can be too hard for comfortable use in regions of the insole such as the forefoot and heel. Contrastingly, Softer materials like memory foams or other low durometer foams provide higher levels of comfort and shock absorption but lack the stiffness needed for proper support in insole region such as the arch.

SUMMARY OF THE INVENTION

According to some embodiments, a cushioning member is configured with sets of protrusions that extend from a base by varying amounts such that adjacent protrusions are at different heights with respect to one another. The distal ends of the protrusions form an outer surface of the cushioning member so that an object in contact with the cushioning member contacts the distal ends of taller protrusions first. The taller protrusions deform and absorb energy in response to pressure applied by the object, which provides cushioning. Continued application of pressure further deforms the taller protrusions to the point that the object comes into contact with shorter protrusions. The additional resistance to the pressure that is provided by the shorter protrusions increases the level of support provided by the cushioning member. Thus, by providing protrusions of differing heights, differing balances between cushioning and support can be provided by the cushioning member. The cushioning member can provide relatively high cushioning initially, followed by cushioning with comparatively greater support and resilience.

In some embodiments, the cushioning member is an insole for footwear and the protrusions are provided in areas of highest impact such as the heel and/or forefoot portions of the insole. Insoles can be tailored for a specific application by configuring the protrusions to provide the right balance between cushioning, support, and resilience for the application. Protrusion configuration variables such as the shapes, sizes, relative heights, and materials, can be selected to achieve the ideal balance for the application. Thus, the desired performance of an insole can be achieved by optimizing the structural and material characteristics of the protrusions.

According to some embodiments, a cushioning member includes a base, a plurality of protrusions extending from at least a portion of the base, the protrusions being configured to deform to provide cushioning, and an outer surface at least partially formed from distal ends of the protrusions, wherein at least a portion of a first protrusion is taller than an adjacent portion of a second protrusion so that the portion of the first protrusion deforms prior to the adjacent portion of the second protrusion in response to a pressure applied by a planar surface in contact with the outer surface of the cushioning member.

In any of these embodiments, the first and second protrusions may be walls that extend along the base. In any of these embodiments, the walls may curve along the base. In any of these embodiments, the walls may curve sinusoidally along the portion of the base.

In any of these embodiments, a base of the first protrusion may be spaced apart from a base of the second protrusion. In any of these embodiments, the first and second protrusions may be first and second walls and the base of the first wall may be spaced apart from the base of the second wall along an entire length of the first wall.

In any of these embodiments, a height of the first protrusion may vary along a length of the first protrusion. In any of these embodiments, the entire first protrusion may be taller than the entire second protrusion. In any of these embodiments, at least the first protrusion may be made from elastomeric gel or cellular foam.

In any of these embodiments, a first set of protrusions of the plurality of protrusions may be taller than a second set of protrusions of the plurality of protrusions and each protrusion in the first set of protrusions may be adjacent to a protrusion in the second set of protrusions.

In any of these embodiments, protrusion height may alternate from one protrusion to the next. In any of these embodiments, at least a portion of the outer surface may have a rippled shape that is formed by the distal ends of the protrusions. In any of these embodiments, the rippled shape may be a sinusoidal shape.

In any of these embodiments, at least a portion of the outer surface may have a stepped shape that is formed by the distal ends of the protrusions. In any of these embodiments, at least a portion of the outer surface may have a saw-tooth shape formed by the distal ends of the protrusions. In any of these embodiments, the portion of the base may be a recess and the first and second protrusions extend from a bottom of the recess.

In any of these embodiments, a height of the portion of the first protrusion may be greater than a depth of the recess. In any of these embodiments, a height of the adjacent portion of the second protrusion may be less that the depth of the recess.

According to some embodiments, a removable insole for footwear includes a base, a plurality of walls extending from and curving along at least a portion of the base, the walls being configured to deform to provide cushioning, and an outer surface at least partially formed from distal ends of the walls, wherein at least a portion of a first wall is taller than an adjacent portion of a second wall so that the portion of the first wall deforms prior to the adjacent portion of the second wall in response to a pressure applied by a planar surface in contact with the outer surface of the cushioning member.

In any of these embodiments, a base of the first wall may be spaced apart from a base of the second wall along an entire length of the first wall.

In any of these embodiments, at least a portion of the outer surface may have a stepped shape that is formed by distal ends of at least some of the walls. In any of these embodiments, the at least a portion of the outer surface having the stepped shape may be in a forefoot portion of the insole.

In any of these embodiments, at least a portion of the outer surface may have a rippled shape that is formed by distal ends of at least some of the walls. In any of these embodiments, the at least a portion of the outer surface having the rippled shape may be in a heel portion of the insole.

In any of these embodiments, the portion of the base may be a recess and the first and second walls extend from a bottom of the recess. In any of these embodiments, a height of the portion of the first wall may be greater than a depth of the recess. In any of these embodiments, a height of the adjacent portion of the second wall may be less than a depth of the recess.

In any of these embodiments, at least the first wall may be made from cellular foam or elastomeric gel. In any of these embodiments, a heel insert may be in the heel portion, and the heel insert may include at least a portion of the walls.

In any of these embodiments, the base may be made from a different material than at least some of the walls. In any of these embodiments, a cover layer may be provided on a side of the base opposite the walls. In any of these embodiments, the insole may include an arch support.

In any of these embodiments, a forefoot portion of the insole may include walls extending from a first recess forming a stepped outer surface and a heel portion of the insole may include walls extending from a second recess forming a ripple outer surface. In any of these embodiments, a height of taller walls in the forefoot portion may be greater than a depth of the first recess. In any of these embodiments, the walls and base may be made of a styrene-ethylene-butylene-styrene (SEBS) gel. In any of these embodiments, walls of uniform height may be provided in an arch portion of the insole.

In any of these embodiments, the walls in the forefoot portion may be made of polyurethane foam and the walls in the arch portion and the heel portion may be made of polyurethane gel. In any of these embodiments, the base may be made of polyurethane foam and the walls in the forefoot portion and heel portion may be made of polyurethane gel. In any of these embodiments, the insole may include an arch shell made of polypropylene.

BRIEF DESCRIPTION OF THE DRAWINGS

The invention will now be described, by way of example only, with reference to the accompanying drawings, in which.

DETAILED DESCRIPTION OF EXEMPLARY EMBODIMENTS

Figure 1:
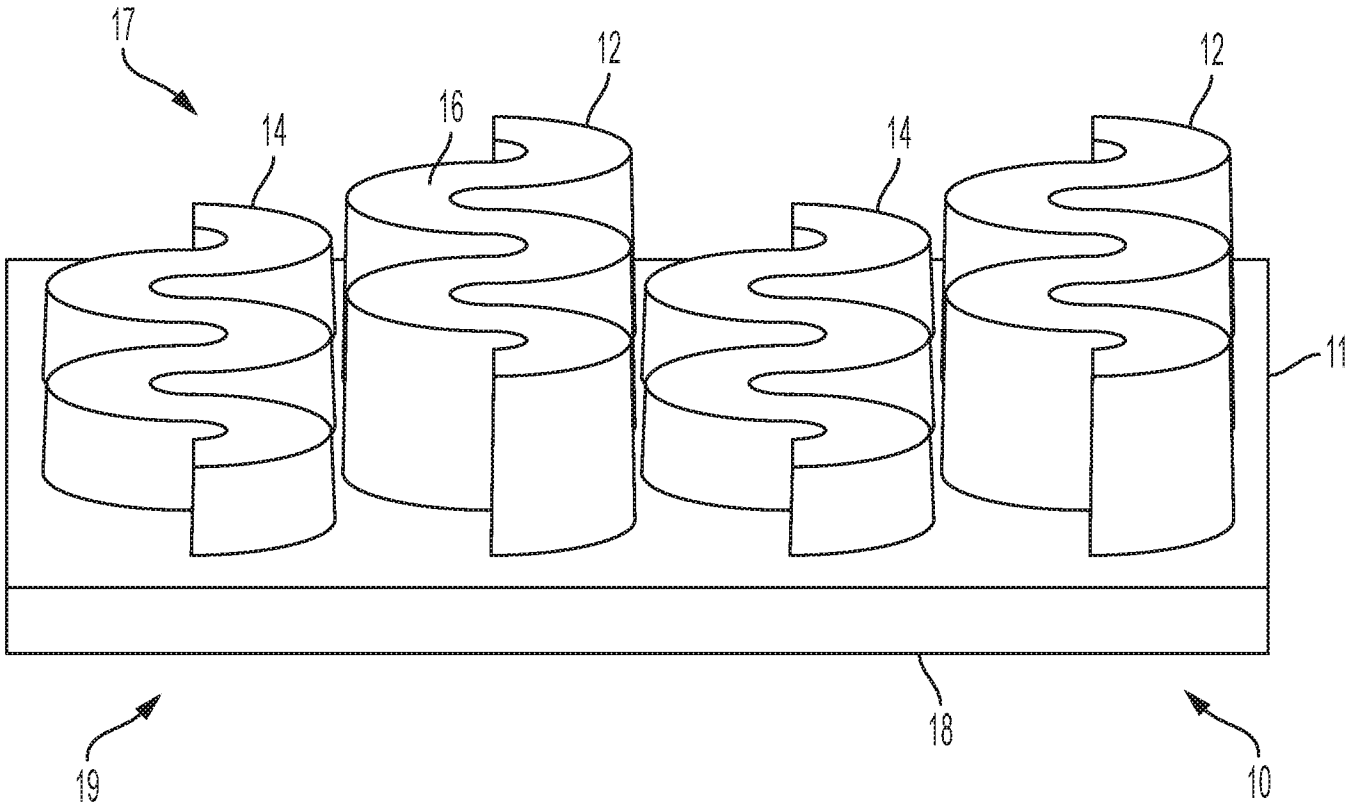
FIG. 1 shows a cushioning member, according to one embodiment.

Described herein are cushioning members that include deformable protrusions that extend from a base and form an outer surface of the cushioning members. The protrusions have varying height resulting in a non-uniform outer surface. Initial compression results in deformation of protrusions or portions of protrusions of greatest height. Continued compression results in deformation of shorter protrusions or shorter portions of protrusions in combination with continued deformation of the taller protrusions. By providing protrusions of varying height, the balance between cushioning, support, and resilience can be a function of the amount of pressure applied. The initial resistance to compression provided by taller protrusions can provide cushioning with lessened support while the resistance to compression provided by the taller protrusions in combination with shorter protrusions can provide relatively higher support and resilience. The shapes, heights, widths, materials, and other protrusion configuration parameters can be selected to achieve a performance tailored to a given application.

Generally, cushioning members include a base that extends the width and breadth of the member. The protrusions extend perpendicularly from one side of the base such that distal ends of the protrusions form portions of an outer surface of the cushioning member. During use, pressure is applied by an object to be cushioned in a direction that is generally perpendicular to the base such that protrusions are placed under generally compressive load, either through direct contact between the protrusions and the object to be cushioned or by direct contact between the protrusions and a surface forming the support surface for the cushion (with the object to be cushioned being in contact with the side of the base opposite the side with protrusions).

As pressure is applied by the object to be cushioned, the protrusions or portions of protrusions that extend from the base to the greatest degree (the protrusions in contact with the object to be cushioned or the support surface, as the case may be) begin to deform under the compressive load. This deformation provides cushioning with less resilience compared to cushions of uniform thickness due to the reduced amount of material available to resist the pressure. As the pressure applied by the object increases, protrusions or portions of protrusions at lower heights come into contact with the object or support surface and begin to deform, providing greater support and resilience than initially provided. Thus, cushioning members can be configured to provide relatively high cushioning initially and then relative high support and resilience as more pressure is applied.

In some embodiments, the cushioning member is an insole for footwear in which the base may include an upper side that is contoured to match the general contours of the bottom of a typical foot. The protrusions may extend from a bottom side of the base opposite the contours so as to contact the inside of a shoe. Protrusions may be provided in areas of highest load, such as the heel and/or forefoot areas, and may be configured to provide the ideal balance between cushioning and support. An insole may be tailored to a particular application by configuring the protrusions—e.g., height, width, spacing, material, etc.—to provide the balance tailored to the particular application. For example, a removable insole tailored for support while standing may be configured for greater energy absorption, whereas an insole tailored for walking or running may be configured for greater energy rebound.

In insoles with varying height walls, according to the principles described herein, areas receiving high pressure from a wearer can provide greater support and resilience due to the involvement of a greater proportion of protrusions in providing support and resilience. And at the same time, areas receiving lower pressure from the wearer can provide less resilient cushioning—a softer feel—due to the involvement of fewer of the protrusions or portions of protrusions. This combination of a more supportive and resilient response in higher pressure areas to softer response in lower pressure areas can provide an increased feeling of comfort for a wearer.

Further, according to some embodiments, for insoles under compressive loads seen when sitting or standing, a lesser proportion of the protrusions are under compression, which provides a cushioning feel similar to that of a softer material of uniform thickness. Under higher load instances, such as during walking and running, full involvement of the protrusions will provide a response that is more similar to that of a uniform thickness cushioning material. Thus, an insole can provide both cushioning for standing or sitting while providing support and resilience for running or walking.

In the following description of the disclosure and embodiments, reference is made to the accompanying drawings in which are shown, by way of illustration, specific embodiments that can be practiced. It is to be understood that other embodiments and examples can be practiced, and changes can be made, without departing from the scope of the disclosure.

In addition, it is also to be understood that the singular forms "a," "an," and "the" used in the following description are intended to include the plural forms as well, unless the context clearly indicates otherwise. It is also to be understood that the term "and/or"," as used herein, refers to and encompasses any and all possible combinations of one or more of the associated listed items. It is further to be understood that the terms "includes, "including," "comprises," and/or "comprising," when used herein, specify the presence of stated features, integers, steps, operations, elements, components, and/or units, but do not preclude the presence or addition of one or more other features, integers, steps, operations, elements, components, units, and/or groups thereof.

FIG. 1 is a portion of a cushioning member 10 according to one embodiment. Cushioning member 10 includes a plurality of protrusions of varying height that extend from a base 11. In the illustrated embodiment, the protrusions are in the form of taller walls 12 and shorter walls 14 that each curve along and extend perpendicularly from one side of the base 11. The distal ends 16 of the walls form an outer surface 17 of the cushioning member 10 while the opposite side 18 of the base 11 may form a second outer surface 19 of the cushioning member 10. An object to be cushioned can contact either outer surface 17 or second outer surface 19 with the other outer surface resting against a support surface.

During cushioning, the object to be cushioned or the external support surface contacts and applies pressure to the distal ends of the taller walls 12 first. In the illustrated embodiment, the taller walls 12 and shorter walls 14 alternate such that an object in contact with the distal ends of the walls contacts every other wall. As the object (or support surface) applies pressure, the taller walls 12 deform, providing cushioning. This initial deformation provides a first cushioning regime that is less resilient than would be the case if all walls had the same height or the cushioning member were of uniform thickness. The taller walls 12 may continue deforming to the point that the object or external support surface comes into contact with the distal ends of the shorter walls 14. In response to increasing pressure, the shorter walls 14 deform, which in combination with the continued deformation of the taller walls 12, provides a second cushioning regime that is more resilient than the first regime since more walls support the applied pressure. By having walls of varying heights, the cushioning member 10 can provide softer cushioning while still providing sufficient support and resilience for relatively high applied pressure.

Cushioning members according to some embodiments may be configured for any suitable cushioning application. For example, a cushioning member may be a floor mat, a mattress cover, a pillow, packaging, an insole, or a portion of any of these. The shape, heights, height variations, widths, spacing, etc. of the walls or other protrusions can be tailored to provide the optimized balance between cushioning and support for a given application. Protrusions of any configuration may be provided, including straight walls, zig-zagging walls, pins, cylinders, domes, pyramids, blocks, or any other suitable shape. For example, in some embodiments, the walls are formed of semi-circles of alternating orientation that are connected at their ends. In other embodiments, curved walls may have generally sinusoidal curvature. Non-exhaustive examples of protrusion configurations are discussed further below.

Figure 2:
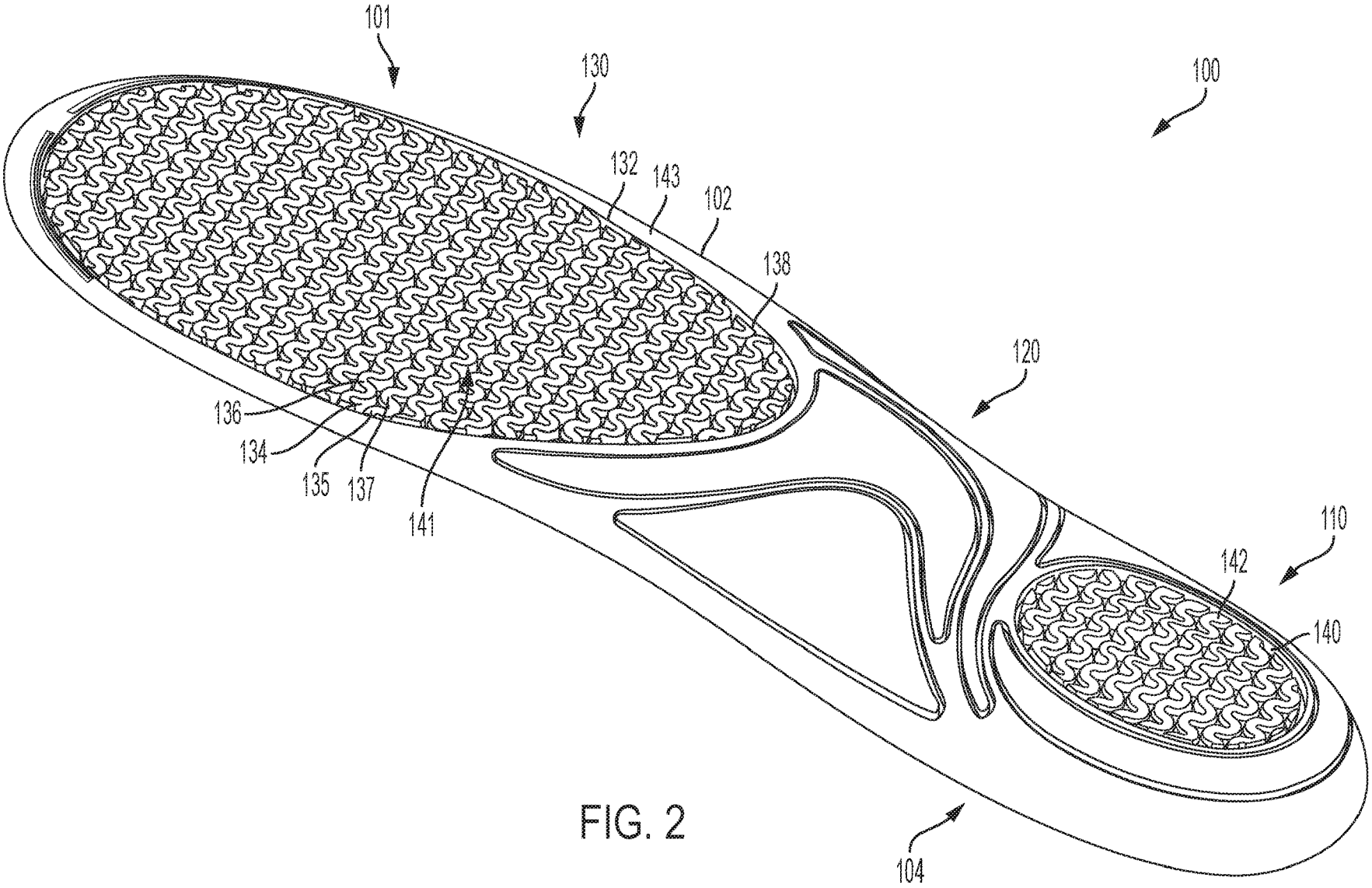
FIG. 2 is a bottom perspective view of an insole, according to a first embodiment.
Figure 3:
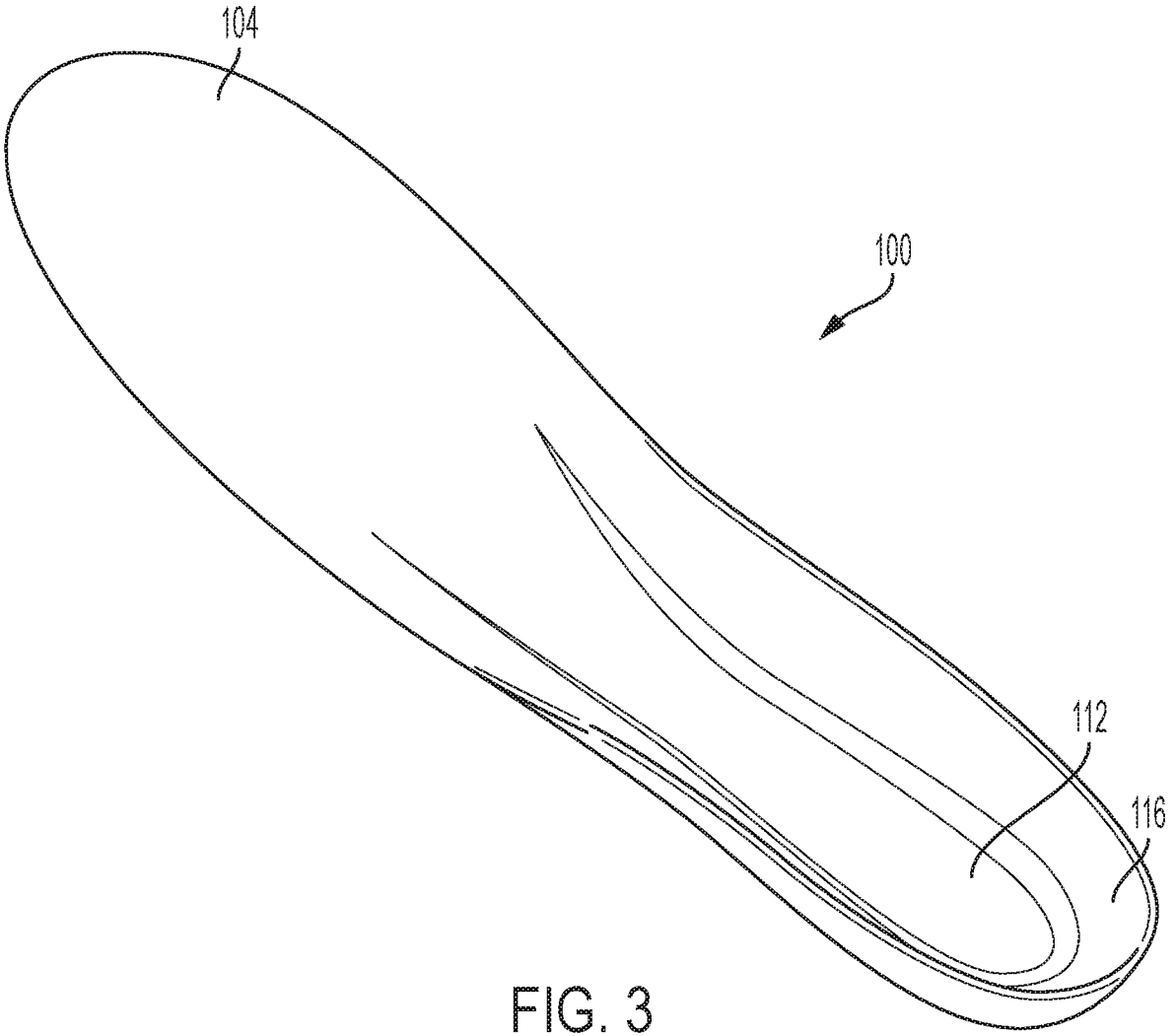
FIG. 3 is a top perspective view of an insole, according to one embodiment.

FIGS. 2 and 3 illustrate a left-foot insole 100 incorporating protrusions of varying heights according to one embodiment. Although the figures and following description describe a left-foot insole, it is to be understood that the right-foot insole is generally a mirror image of the left-foot insole, and thus, the features described below pertain to a right-foot insole as well.

Insole 100 includes heel portion 110, arch portion 120, and a forefoot portion 130. The perimeter of insole 100 is generally shaped to follow the outline of a typical wearer's foot. Moving from back to front along the insole 100, the forefoot portion 130 broadens slightly to a maximum width that may be configured to be located generally beneath the broadest portion of a wearer's foot, i.e., beneath the distal heads of the metatarsals. Forefoot portion 130 then narrows into a curved end that may be shaped to follow the general outline of the toes of a typical wearer's foot. Moving rearward from forefoot portion 130, the arch portion 120 and heel portion 110 narrow slightly to a curved end configured to follow the outline of a typical wearer's heel.

The upper surface of the forefoot portion 130 may be generally flat and the upper surface of the arch portion 120 may be contoured to follow the shape of a typical wearer's arch. Heel portion 110 is generally cup shaped and configured to underlie a typical wearer's heel. Heel portion 110 may include a relatively flat central portion 112 and a sloped side wall 116 that extends around the sides and rear of central portion 112. Generally, when a heel strikes a surface, the fat pad portion of the heel spreads out. A cupped heel portion thereby stabilizes the heel of the wearer and maintains the heel in heel portion 110, preventing spreading out of the fat pad portion of the heel and also preventing any side-to-side movement of the heel in heel portion 110.

The insole 100 includes a base 102, which may extend the entire length and breadth of the insole 100. In some embodiments, a cover layer 104 is secured to the upper surface of base 102 along the entire length of insole 100. Cover layer 104 may be secured by any suitable means, such as adhesive, radio frequency welding, etc. The cover layer may be a material configured for comfort when in contact with skin of the wearer. The material may be any suitable material, such as natural or synthetic cloth or leather.

The bottom 101 of the insole 100 is illustrated in the perspective view of FIG. 2. A first region 132 of the bottom 101, which is in the forefoot portion 130, includes protrusions that are in the forms of taller walls 134 and shorter walls 135. These walls extend perpendicularly from the bottom of a recess 138 of the base 102 by different amounts, with all of the taller walls 134 extending to a first height and all of the shorter walls 135 extending to a second height. The walls 134, 135 turn side-to-side relative to their longitudinal extent, which in the illustrated embodiment is formed by repeating semi-circles. This shape is also referred to herein as a generally sinusoidal curve.

Distal ends 136 of the walls 134 and distal ends 137 of the walls 135 form an outer surface 141 of the insole 100 in the first region 132. Due to the dual heights of the walls 134, 135, the outer surface 141 has a stepped shape. An object in contact with the outer surface 141 contacts distal ends 136 first and then distal ends 137 once the taller walls 134 have compressed sufficiently.

Figure 4:
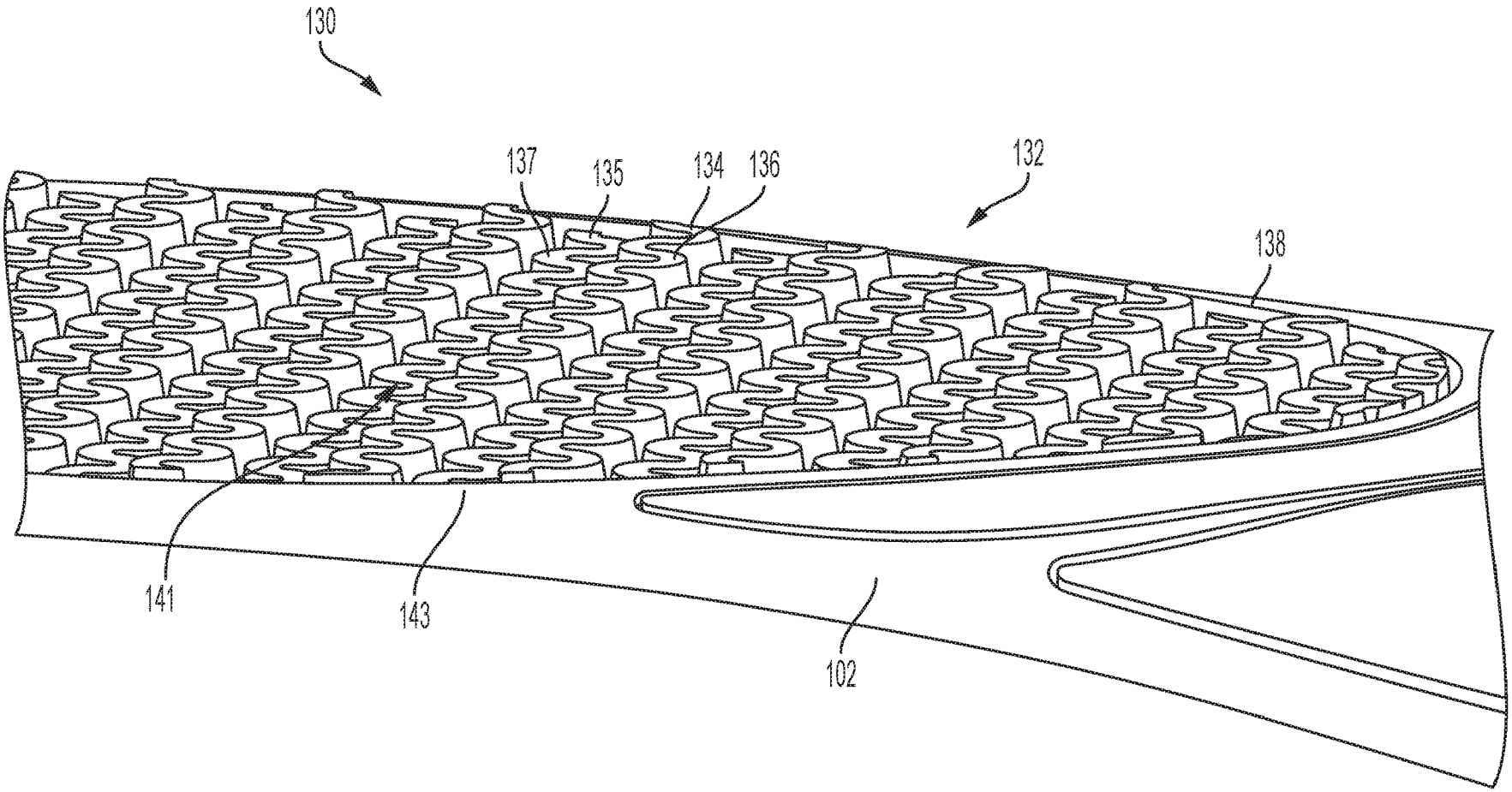
FIG. 4 is an enlarged perspective view of the forefoot portion of the insole of FIG. 2.
Figure 5:
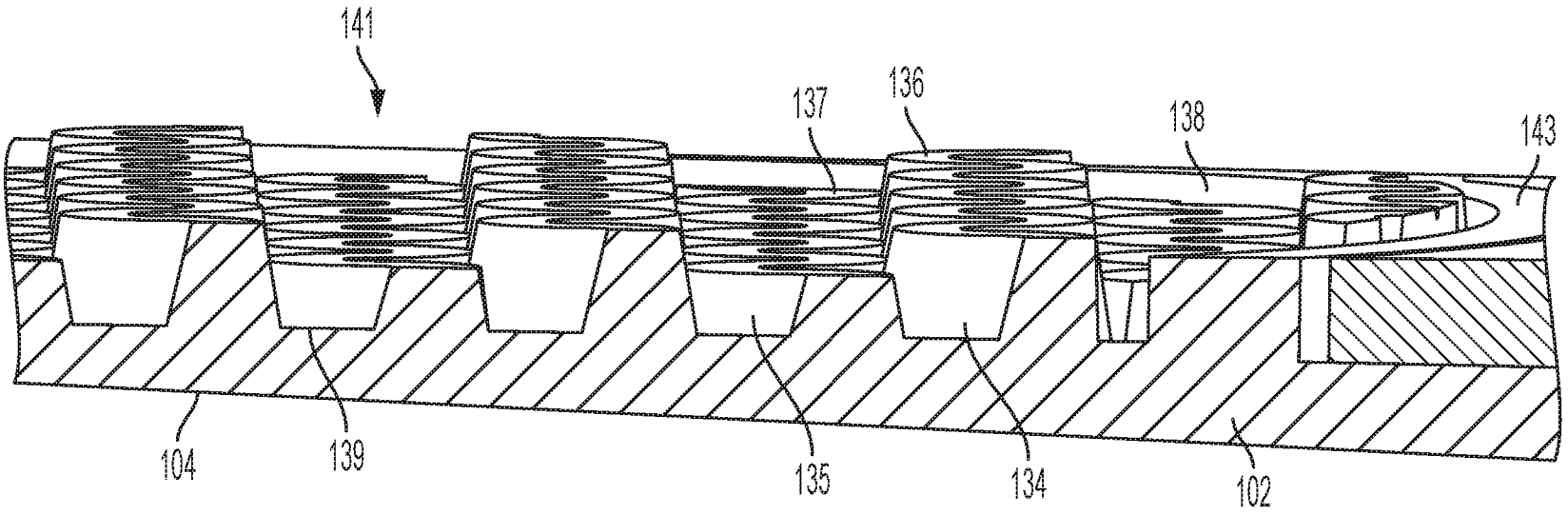
FIG. 5 is cross section through the forefoot portion of the insole of FIG. 2 and FIG. 4.

An enlarged perspective view of a portion of first region 132 is illustrated in FIG. 4, and a perspective view of an enlarged cross section through the first region 132 is provided in FIG. 5 to better illustrate the height differences between the taller walls 134 and the shorter walls 135, according to one embodiment. The first region 132 includes a recess 138 formed in the base with the walls 134, 135 extending perpendicularly from the bottom 139 of the recess 138. The taller walls 134 extend from the bottom 139 of the recess 138 by a greater amount than the shorter walls 135 and alternate with the shorter walls 135 such that the heights of adjacent walls are different from one another. For example, the wall at the right side of the recess in FIG. 5 is a taller wall 134, the adjacent wall to the left is a shorter wall 135, and the next wall to the left is another taller wall 134. This pattern continues across the first region 132.

During compression of the insole 100 in use, such as during standing or walking, the taller walls 134 begin to deform first before the shorter walls 135 in response to the pressure applied by (or to) an external object, such as the inside of the shoe. This deformation of the taller walls 134 provides a first level of resistance to the applied pressure that is lower than would be provided by comparable walls of uniform height or an insole with a comparable but uniform thickness through the region, which can result in a more cushioned feel. As more pressure is applied, the taller walls 134 deform to the point that the shorter walls 135 come into contact with the external object and begin to deform along with the taller walls 134. This combination of the continued deformation of the taller walls 134 and the deformation of the shorter walls 135 provides a second level of resistance that can be more supportive and provide more resilience. Thus, the insole 100 can provide a cushioning feel during initial compression, while still providing adequate support and resilience for higher pressure.

In some embodiments, the height of the taller walls 134 is greater than the depth of the recess 138 such that the taller walls 134 extend past (i.e., above or below depending on the reference point) the portions 143 of the base surrounding the recess 138. According to some embodiments, this can provide an additional degree of cushioning feel since the initial compressive pressure may be taken up only or primarily by the taller walls 134 before the portions 143 of the base surrounding the recess 138 begin to compress. In some embodiments, the height of the shorter walls 135 is also greater than the depth of the recess 138. In some embodiments, the height of the taller walls 134 is substantially equal to the depth of the recess 138 such that the distal ends of the taller walls 134 are coplanar with the portions 143 of the base 102. In other embodiments, the height of the taller walls 134 is less than the depth of the recess 138 such that some deformation of the surrounding portions 143 of the base 102 is required before the distal ends of the taller walls 134 will come into contact with a planar external object.

The walls 134, 135 may extend transversely to the longitudinal direction of the insole (i.e., heel to toe) or parallel to the longitudinal direction. Transversely extending walls may be perpendicular to the longitudinal direction, such as in the embodiment illustrated in FIGS. 1-3, or at an acute angle thereto. The walls 134, 135 may extend parallel to one another and may be spaced apart such that the walls 134, 135 do not touch when under no load. The walls 134, 135 may be spaced and configured such that they do not touch one another during normal loading or may be spaced and configured such that at least some portions of adjacent walls contact during loading. For example, the taller walls 134 may bulge to the sides during compression to the point that they contact adjacent portions of shorter walls 135.

Figure 6:
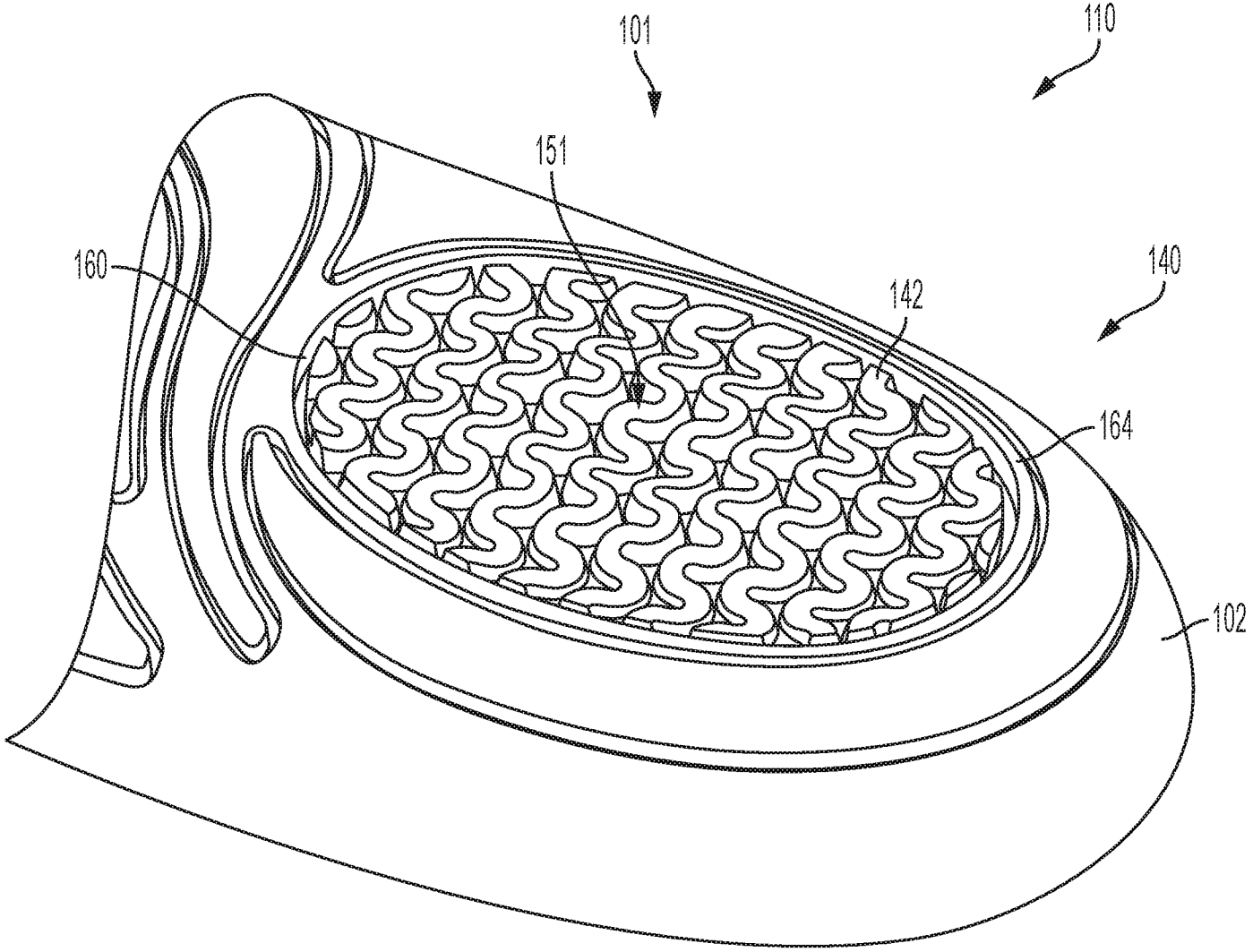
FIG. 6 is an enlarged perspective view of the heel portion of the insole of FIG. 2.

A second region 140 of the bottom 101 of the insole 100, which is in the heel portion 110, is illustrated in FIG. 6. Like the first region 132, the second region 140 includes a plurality of protrusions in the form of walls 142 that extend perpendicularly from and curve along the bottom of a recess 160 in the base 102. However, unlike walls 134, 135, the walls 142 in the second region each vary in height across their length and width. The height variations form an irregular outer surface 151 in the second region 140 that can be characterized as an elliptical ripple outer surface.

Figure 7:
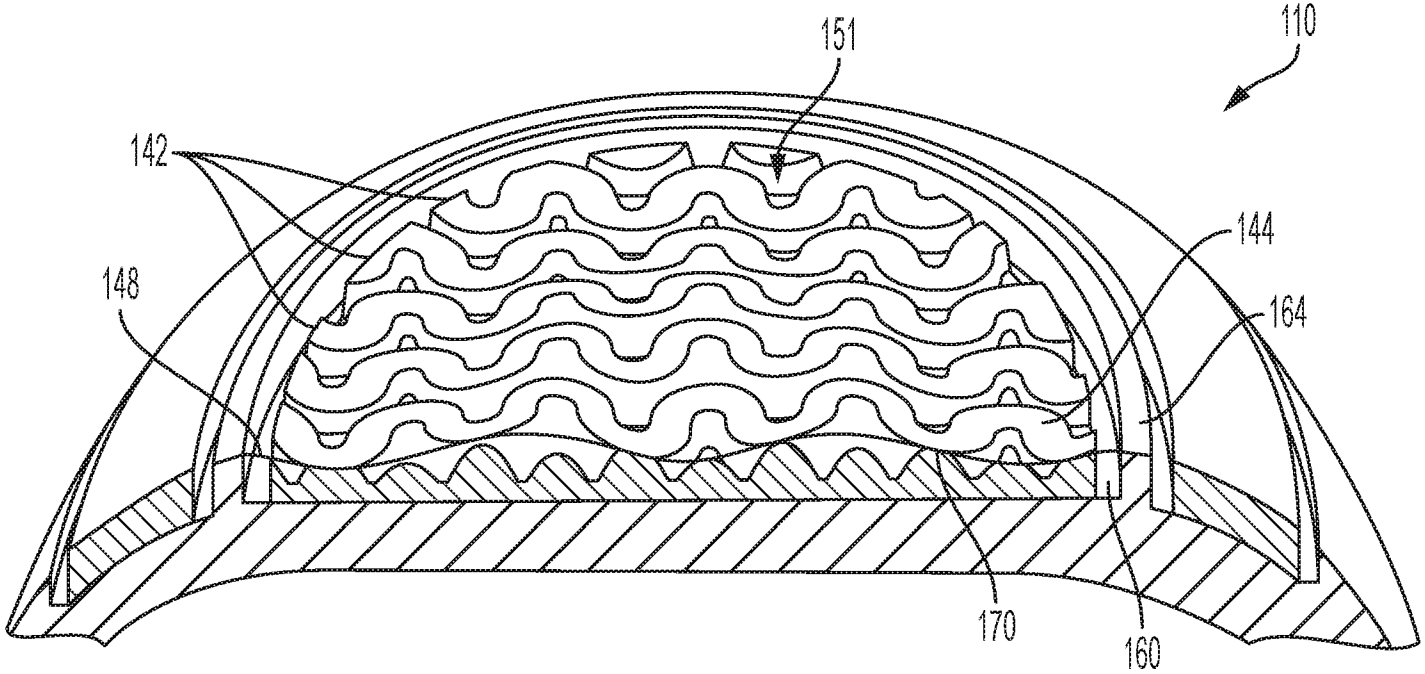
FIG. 7 is a longitudinal cross section through the heel portion of FIG. 6.
Figure 8:
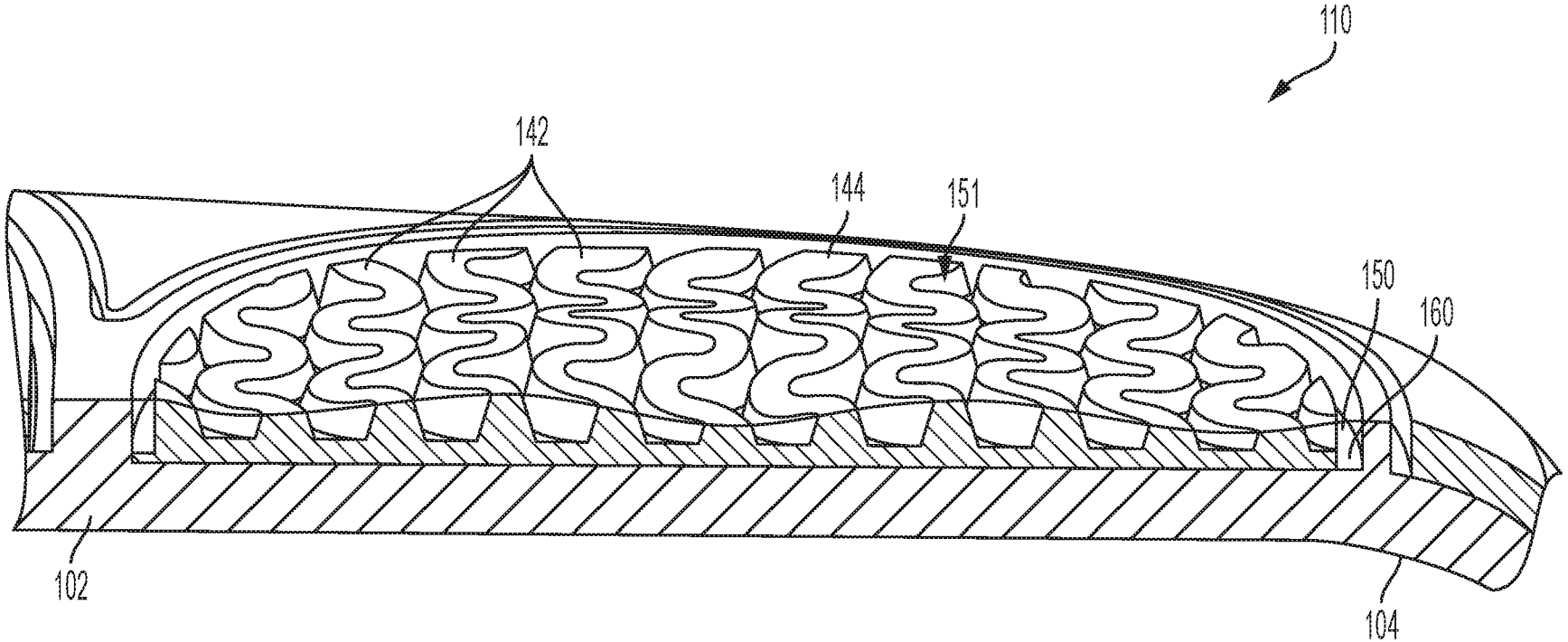
FIG. 8 is a transverse cross section through the heel portion of FIG. 6.

FIG. 7 is a cross section that extends perpendicularly to the longitudinal direction of the insole 100 through a central portion of the heel portion 110. The intersections of the distal end 170 of a wall 144 with the cutting plane are marked in FIG. 7. These marks extend along a sinusoidal line 148. FIG. 8 illustrates a cross section also through the central portion of the heel portion 110, but perpendicular to the cross section of FIG. 7. The distal ends of the walls 142 are configured so as to follow a sinusoidal line 150. The period of this sinusoidal line 150 is greater than the period of the sinusoidal line 148 of FIG. 7, so as to have the same numbers of peaks and valleys over a greater distance (due to the oval shape of the heel portion 110). However, the periods of the sinusoidal lines need not be the same. The blending of sinusoidal line 148 into sinusoidal line 150 creates an elliptical ripple surface that the outer surface 151 (which is created by distal ends of the walls 142) follows.

With this ripple shape, the heights of adjacent portions of walls 142 are different from one another. For example, in FIG. 8, the height of the portion of wall 144 that is intersected by the cutting plane is less than the adjacent portion of the wall to the left in FIG. 8. Similarly, as shown in FIG. 7, the height of walls 142 follows the sinusoidal line 150.

In use, the distal-most portions of the walls 142, which may be in contact with an external object such as a wearer's foot or the inside of the wearer's shoe, are compressed first. Since only a portion of the walls 142 are involved in the initial compression due to the varying height, the relative stiffness is less than would be the case if the walls had uniform height or if the insole was of uniform thickness, which may result in a more cushioned feel. As compression continues and the walls 142 deform, more and more portions of the walls 142 come into contact with the external object or surface, which provides more resistance to the compression, resulting in more support and resilience.

In the illustrated embodiment, the walls 142 extend perpendicularly to the longitudinal direction of the insole. In other embodiments, the walls 142 may extend at an acute angle to the longitudinal direction or parallel to the longitudinal direction. The walls 142 may be spaced from one another such that they do not touch one another during normal loading or may be spaced such that at least some portions of adjacent walls contact during loading. For example, taller portions of the walls 142 may bulge to the sides during compression to the point that they contact adjacent wall portions.

In some embodiments, the height of the tallest portions of the walls 142 is greater than the depth of the recess 160 such that the tallest portions extend past (i.e., above or below depending on the reference point) the outer surface of the portions 164 of the base 102 that surround the recess 160. This may provide an additional degree of cushioning feel since the initial compressive pressure may be taken up only or primarily by the tallest portions of the walls 142 before the portions 164 of the base surrounding the recess 160 begin to compress. In some embodiments, the height of the shortest portions of the walls 142 is also greater than the depth of the recess 160, and in other embodiments, the height of the shortest portions of the walls 142 is less than the depth of the recess. The height of the tallest portions of the walls 142 may be equal or less than the depth of the recess 160. In some embodiments, the walls 142 extend from a non-recessed portion of the base 102.

Figure 9A:
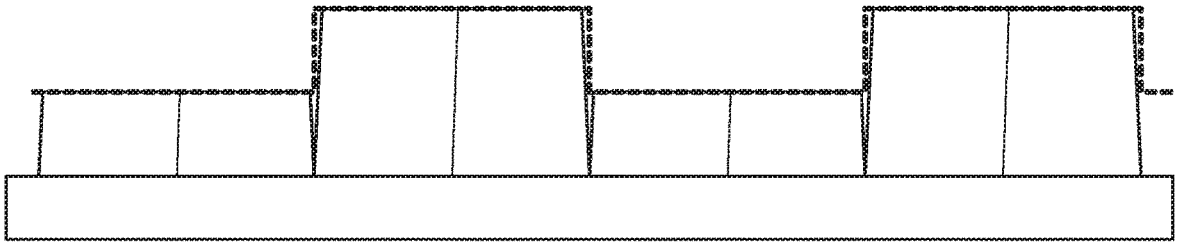
FIGS. 9A-D are side views of different embodiments of cushioning members illustrating different outer surface shapes.
Figure 9B:
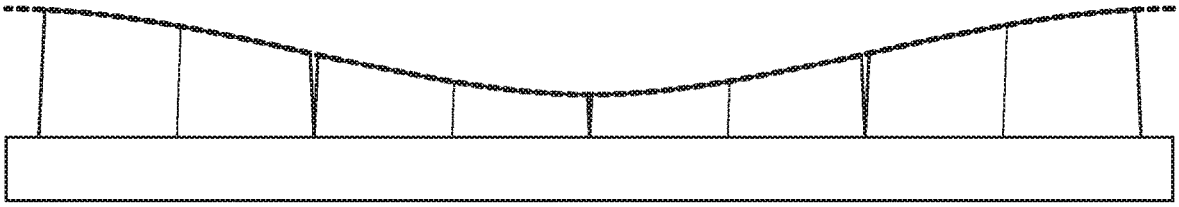
Figure 9C:
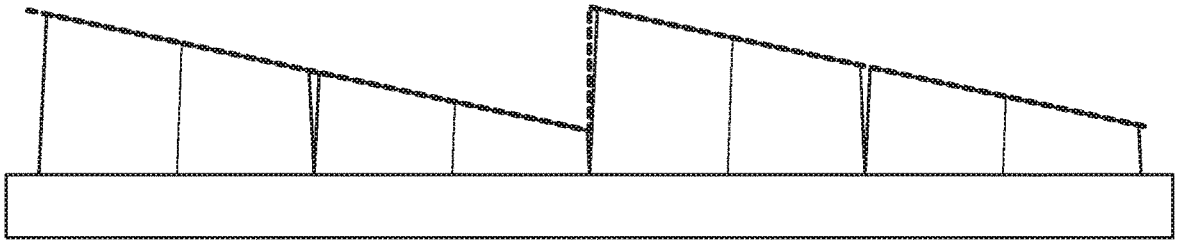
Figure 9D:
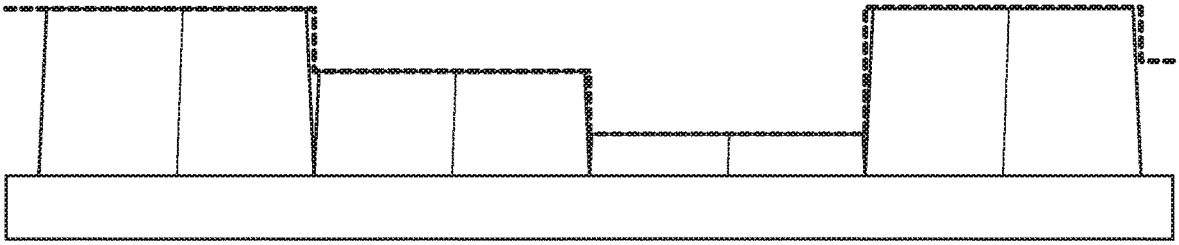

The configurations of the walls 134, 135, and 144 described above are only examples of the wall configurations that may be provided. FIGS. 9A-9D provide side views of non-limiting examples of various wall height configurations that may be included in cushioning members, including insole embodiments, according to some embodiments. The distal ends of the walls in these figures are outlined with dotted lines to emphasize the shape of the outer surface created by the various configurations. FIG. 9A illustrates stepped walls, similar to walls 134, 135 described above. FIG. 9B illustrates a portion of a ripple shaped outer surface similar to that formed by walls 142 as described above. FIG. 9C shows walls that form a saw tooth-like outer surface. FIG. 9D shows walls form a stepped saw-tooth outer surface having three distinct wall heights.

Figure 10A:
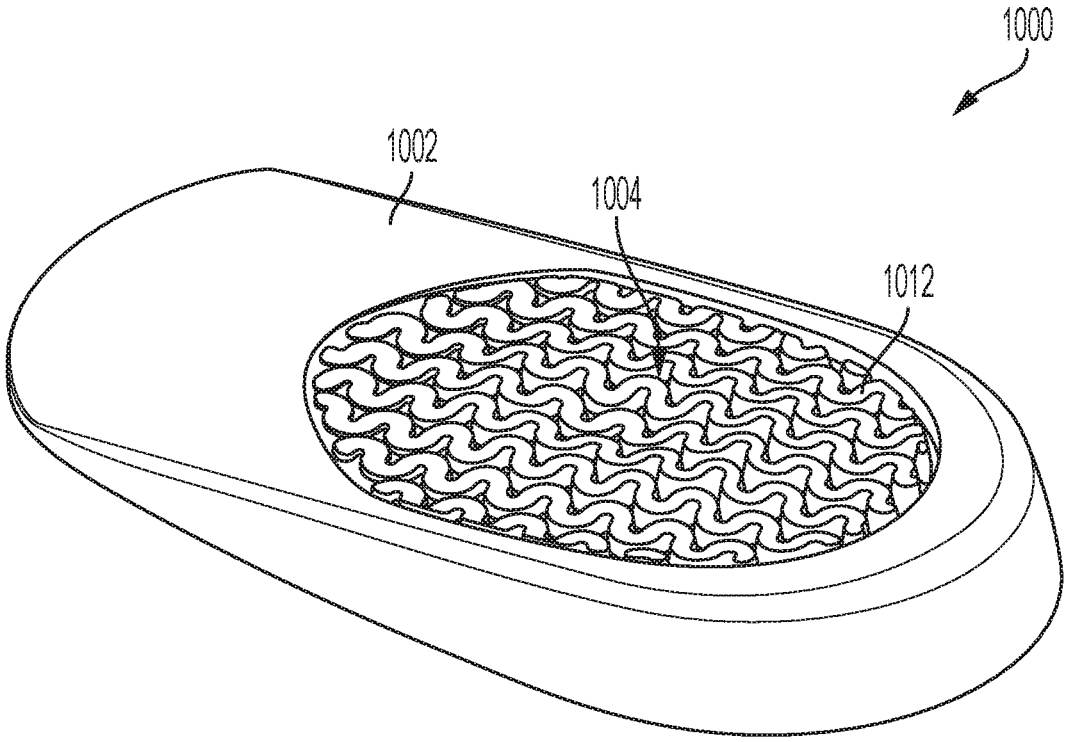
FIGS. 10A and 10B are perspective views of the bottom and top, respectively, of a heel cushion, according to one embodiment.
Figure 10B:
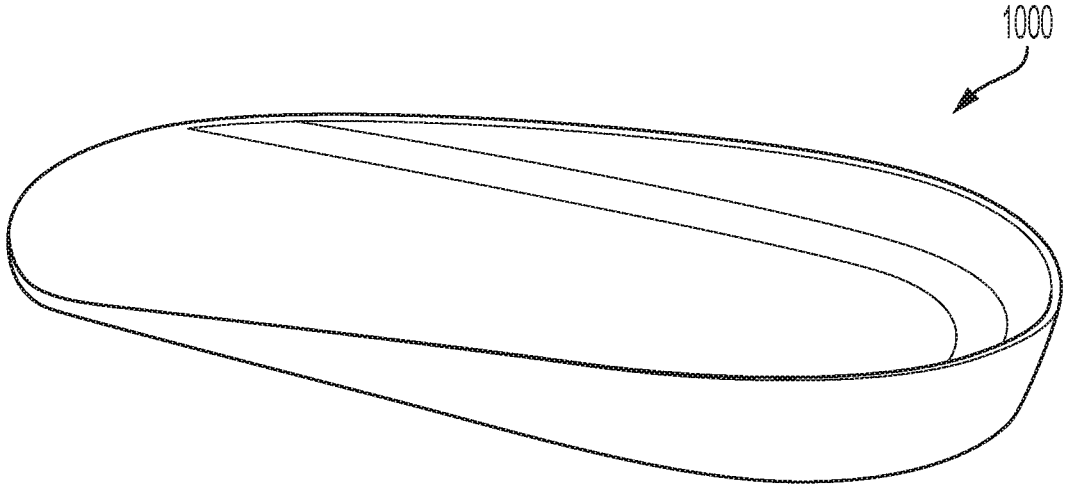

FIGS. 10A and 10B are perspective views of the bottom and top, respectively, of an embodiment of a cushioning member that is in the form of a heel cushion 1000 designed to be inserted into footwear for cushioning just the wearer's heel. Heel cushion 1000 includes a base 1002 and walls 1012 that are shaped to provide an elliptical ripple outer surface 1004, similar to the elliptical ripple outer surface provided by walls 142 of heel portion 110 of insole 100.

Unlike walls 142, the walls 1012 are oriented parallel to the longitudinal extent of the heel cushion 1000. By providing walls oriented in this manner, the heel cushion 1000 will not "walk" within the wearer's shoe. Walking may result from buckling-type deformation of the walls (depending on height and width of the walls and the load applied) in which the walls buckle in the same direction. In heel cushion embodiments there is no arch or forefoot portion to resist walking of the cushion forward within the shoe. By orienting the walls parallel to the longitudinal axis, any buckling will be side-to-side, rather than forward backward within the wearer's shoe, which prevents the heel cushion 1000 from walking forward within the shoe.

Protrusions, such as walls 12, 14, 134, 135, and 142, can have any suitable size, spacing, and shape, and a cushioning member may have any combination of sizes, spacing, and shapes of walls. For example, at the base end of the protrusions, the protrusions may be less than 1 mm thick, less than 5 mm thick, less than 10 mm thick, less than 20 mm thick, or less than 50 mm thick. At the base end, the protrusions may be at least 1 mm thick, at least 2 mm thick, at least 5 mm thick, at least 10 mm thick, or at least 50 mm thick. Protrusions, sets of protrusions, and/or portions of protrusions may be at least 1 mm in height, at least 2 mm in height, at least 5 mm in height, at least 10 mm in height, at least 20 mm in height, or at least 50 mm in height. Protrusions may be no more than 1 mm in height, no more than 2 mm in height, no more than 5 mm in height, no more than 10 mm in height, no more than 20 mm in height, or no more than 50 mm in height. Shorter protrusions or portions of protrusions may be a fraction of the height of taller protrusions or portions of protrusions. For example, the shortest protrusions or portions of protrusions may be at least one-sixteenth, at least one-eighth, at least three-sixteenths, at least one-quarter, at least five-sixteenths, at least three-eighths, at least seven-sixteenths, at least one-half, at least nine-sixteenths, at least five-eighths, at least eleven-sixteenths, at least three-quarters, at least thirteen-sixteenths, at least seven-eighths, or at least fifteen-sixteenths of the height of the tallest protrusions or portions of protrusions. The shortest protrusions or portions of protrusions may be at most one-sixteenth, at most one-eighth, at most three-sixteenths, at most one-quarter, at most five-sixteenths, at most three-eighths, at most seven-sixteenths, at most one-half, at most nine-sixteenths, at most five-eighths, at most eleven-sixteenths, at most three-quarters, at most thirteen-sixteenths, at most seven-eighths, or at most fifteen-sixteenths of the height of the tallest protrusions or portions of protrusions. Protrusions may be spaced apart from one another by at least 1 mm, at least 2 mm, at least 5 mm, at least 10 mm, at least 20 mm, or at least 50 mm Protrusions may be spaced apart by no more than 1 mm, no more than 2 mm, no more than 5 mm, no more than 10 mm, no more than 20 mm, or no more than 50 mm.

Walls, such as 12, 14, 134, 135, and 142, or other protrusion types may be straight sided, tapered, and/or rounded. In some embodiments, the walls are tapered have equivalent thickness at the ends nearest the base, such that shorter walls or shorter portions of walls have a larger distal end surface area than taller walls or taller portions of walls (e.g., due to the relatively lower height truncation of the taper for the shorter walls). The distal end surfaces of walls, according to various embodiments, may be perpendicular to the direction of the height of the walls and generally parallel with the length and breadth of the base. In other embodiments, the distal end surfaces may be angled with respect to the direction of the height of the walls, such as in the saw-tooth configuration of FIG. 9C. In some embodiments, the distal ends of the walls are rounded. Distal ends may be textured to provide improved gripping or may be smooth.

The base, or portions thereof, from which protrusions extend, can be any suitable thickness, including at least 1 mm thick, at least 2 mm thick, at least 5 mm thick, at least 10 mm thick, or at least 50 mm thick. The base can be less than 1 mm thick, less than 5 mm thick, less than 10 mm thick, less than 20 mm thick, or less than 50 mm thick. The base can vary in thickness across its length and width or can be of uniform thickness.

The base and/or protrusions, according to various embodiments, can be made from any suitable material including, but not limited to, any flexible material that can provide cushioning and shock absorption. Suitable shock absorbing materials can include any suitable cellular foam, such as, but not limited to, cross-linked polyethylene, poly (ethylene-vinyl acetate), polyvinyl chloride, synthetic and natural latex rubbers, neoprene, block polymer elastomers of the acrylonitrile-butadiene-styrene or styrene-butadiene-styrene type, thermoplastic elastomers, ethylenepropylene rubbers, silicone elastomers, polystyrene, polyuria, or polyurethane (PU); preferably a flexible polyurethane foam made from a polyol chain and an isocyanate such as a monomeric or prepolymerized diisocyanate based on 4,4'-diphenylmethane diisocyanate (MDI) or toluene diisocyanate (TDI). Such foams can be blown with fluorocarbons, water, methylene chloride or other gas producing agents, as well as by mechanically frothing to prepare the shock absorbing resilient layer. Such foams advantageously can be molded into the desired shape or geometry.

Non-foam elastomers such as the class of materials known as viscoelastic polymers, viscoelastic gels, elastomeric gels, or silicone gels may be used for protrusions and/or the base. Gels that can be used according to various embodiments are thermoplastic elastomers (elastomeric materials), such as materials made from many polymeric families, including but not limited to the Kraton family of styrene-olefin-rubber block copolymers, thermoplastic polyurethanes, thermoplastic poly olefins, polyamides, polyureas, polyesters and other polymer materials that reversibly soften as a function of temperature. A preferred elastomer is a Kraton block copolymer of styrene/ethylene-co-butylene/styrene or styrene/butadiene/styrene with mineral oil incorporated into the matrix as a plasticizer. Suitable gels may also include silicone hydrogels. In some embodiments, the base and/or protrusions may be made from block copolymer styrene-ethylene-butylene-styrene (SEBS) or from a combination of SEBS and ethylene-vinyl-acetate (EVA).

The base and/or protrusions may be made from materials having Shore OO hardness in the range of 40 to 70, as measured using the test equipment sold for this purpose by Instron Corporation of Canton Mass. U.S.A. Preferably the base and/or protrusions have a Shore OO hardness in the range of 45 to 60, and more preferably, in the range of 50 to 55. Such materials may provide adequate shock absorption for the heel and cushioning for the midfoot and forefoot.

In some embodiments, the base can be a laminate construction, that is, a multilayered composite of any of the above materials. Multilayered composites are made from one or more of the above materials such as a combination of EVA and polyethylene (two layers), a combination of polyurethane and polyvinyl chloride (two layers), or a combination of ethylene propylene rubber, polyurethane foam, and EVA (3 layers).

The base and protrusions or portions thereof can be made from the same or different materials. For example, in some embodiments, the base is made from a cellular foam, such as a polyurethane foam, and the protrusions are made from an elastomeric gel, such as a polyurethane gel. In some embodiments, the protrusions extend from a portion of the base that is the same material as the protrusions but a different material than the rest of the base or than other portions of the base. For example, in some insole embodiments, the protrusions may be formed as a portion of a heel insert that is made from an elastomeric gel such that the elastomeric protrusions extend from an elastomeric insert base, and the insert is bonded to a foam insole base such that the portion of the base underlying the elastomeric gel protrusions is a multi-layered base formed of a foam layer and an elastomeric gel layer (the base of the insert). In some embodiments, a different portion of the insole or other cushioning member has protrusions made of a material that is different from the heel insert protrusions, which may be the same as the base (e.g., foam) or different from the base (e.g., a different material altogether or a different hardness). Thus, the same cushioning member (e.g., insole, mat, chair cushion, etc.), according to some embodiments, may have multiple different materials and material hardness in different areas.

The base and/or protrusions can be prepared by suitable conventional methods, such as heat sealing, ultrasonic sealing, radio-frequency sealing, lamination, thermoforming, reaction injection molding, and compression molding, if necessary, followed by secondary die-cutting or in-mold die cuffing. Representative methods are taught, for example, in U.S. Pat. Nos. 3,489,594; 3,530,489; 4,257,176; 4,185,402; 4,586,273, in Handbook of Plastics, Herber R. Simonds and Carleton Ellis, 1943, New York, N.Y.; Reaction Injection Molding Machinery and Processes, F. Melvin Sweeney, 1987, New York, N.Y.; and Flexible Polyurethane Foams, George Woods, 1982, New Jersey; Preferably, the insole is prepared by a foam reaction molding process such as is taught in U.S. Pat. No. 4,694,589.

Protrusions may be formed along with a base, such as in a single molding process, or may be attached to the base after the base is formed. In some embodiments, the protrusions are formed as a portion of an insert that is then mounted to the base. For example, a heel insert that includes protrusions of varying height may be provided and bonded to base 102 in the heel portion 110 of the insole 100. A heel insert with protrusions can be made of a stiffer material than the material of the base 102 to provide additional shock absorption without requiring a large increase in thickness of heel portion 110. Alternatively, the heel insert can be made of a softer material or of the same material. The insert may be secured within a shallow recess on the underside of the base 102. The insert may be secured by any suitable means, such as adhesive, radio frequency welding, etc. The insert can be any suitable shape, such as circular, rectangular, or irregularly shaped. An insert with protrusions of varying height may also be provided for the forefoot portion 130 of an insole, according to some embodiments. With an insert bonded to a base, such as base 102, the portion of the insert from which the protrusions extend is a portion of a multi-layered base 102 for the purposes of the present disclosure.

Figure 11:
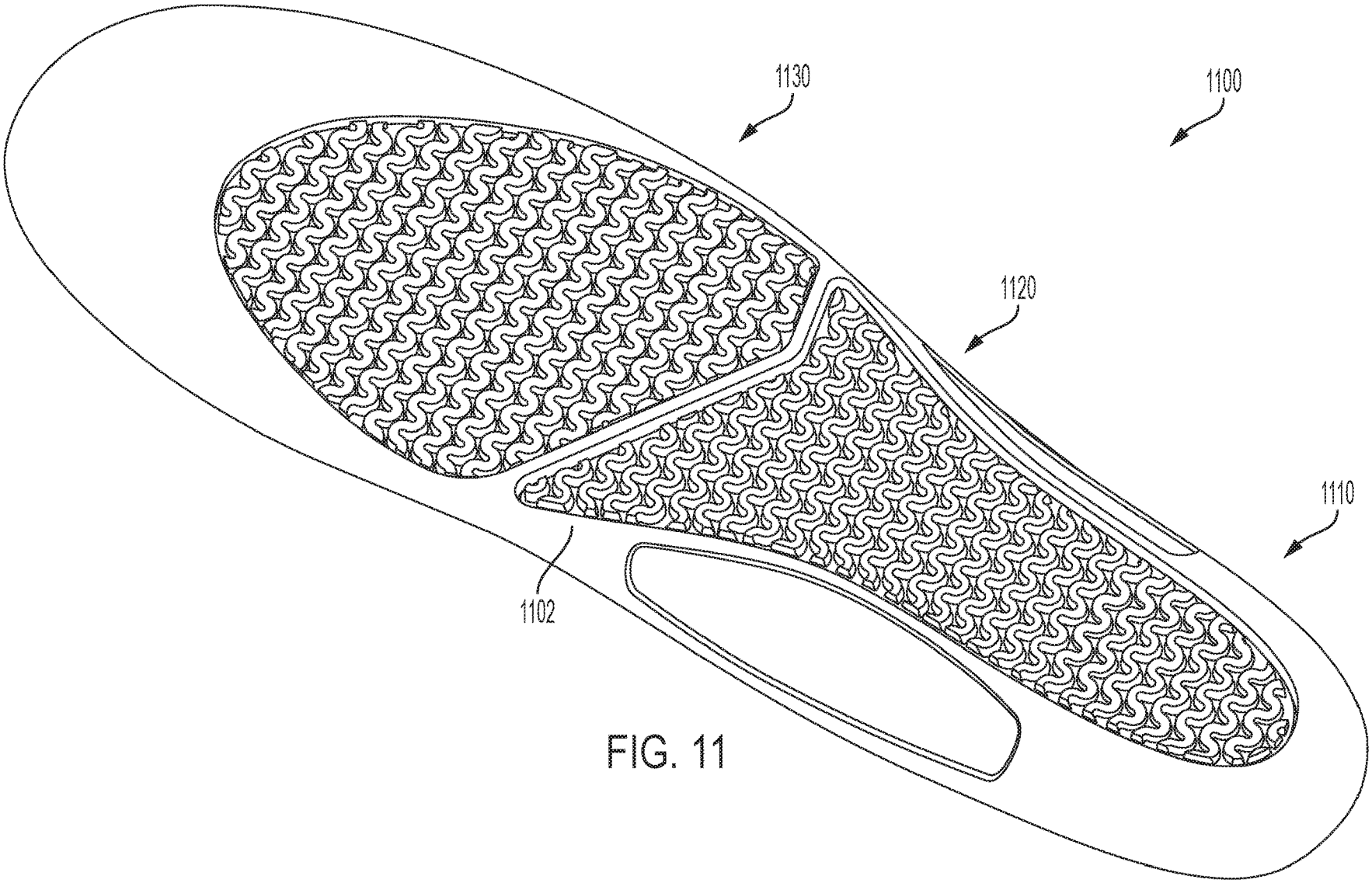
FIG. 11 is a bottom perspective view of an insole, according to a second embodiment.

FIG. 11 is a perspective view of the bottom of an insole 1100, according to one embodiment. Insole 1100 includes sinusoidal walls of alternating height in the forefoot portion 1130, sinusoidal walls of uniform height in the arch portion 1120, and sinusoidal walls of varying height forming an elliptical ripple outer surface in the heel portion 1110. The elliptical ripple outer surface is similar to that described above with respect to the heel portion 110 of insole 100. This configuration may provide optimal performance for comfort and cushioning meant, for example, for work shoes of wearers involved in constant standing and walking. The walls in the forefoot portion 1130 and the base 1102 are made of polyurethane foam. The arch and heel walls are formed of polyurethane gel.

Figure 12:
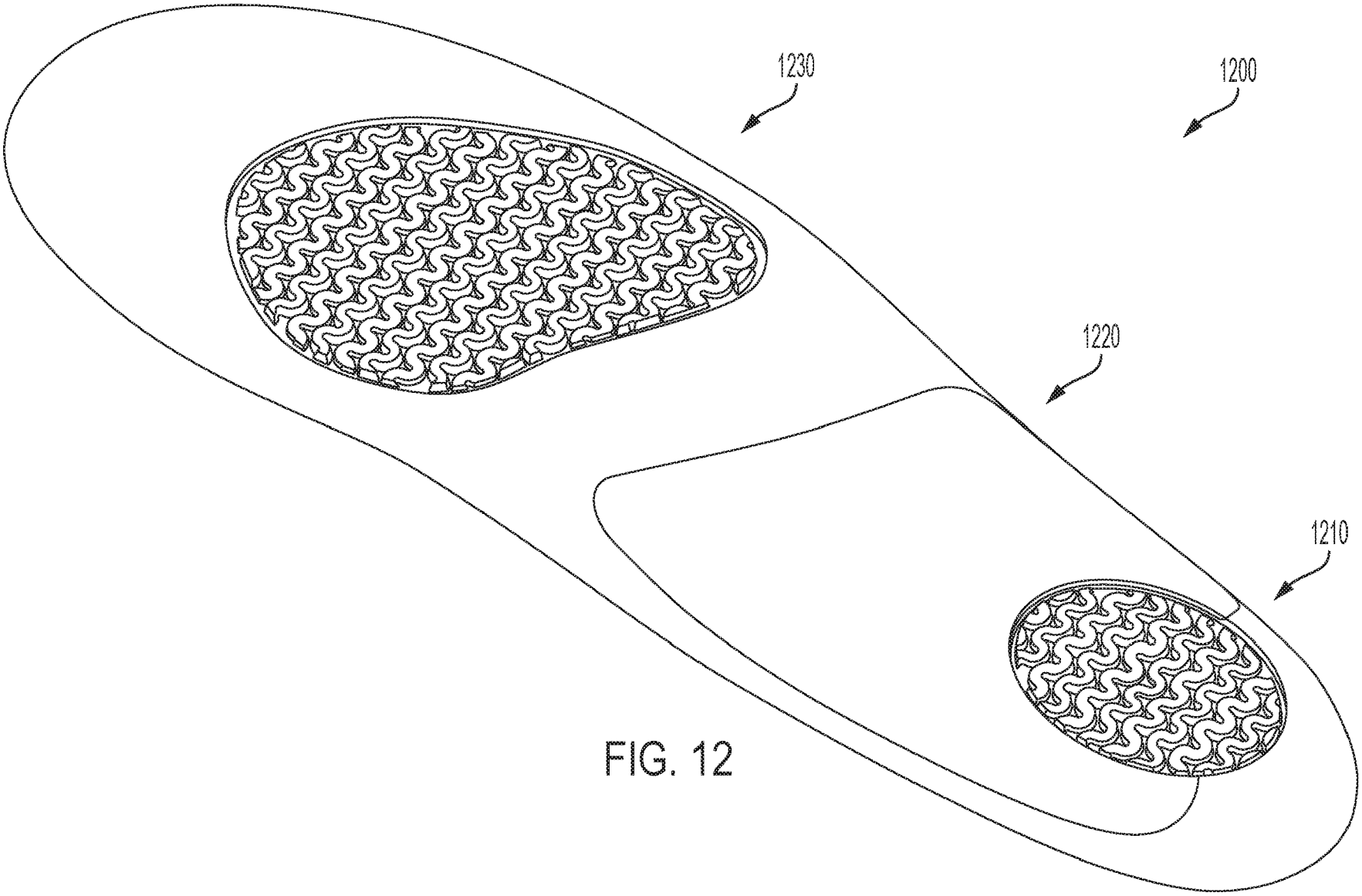
FIG. 12 is a bottom perspective view of an insole, according to a third embodiment.

FIG. 12 is a perspective view of the bottom of an insole 1200, according to one embodiment. Insole 1200 includes sinusoidal walls of alternating height in the forefoot portion 1230, an arch shell in the arch portion 1220, and walls of varying height forming an elliptical ripple outer surface in the heel portion 1210. Optionally, the arch shell may have its edges extended to provide more support and/or stability as the users load transitions from the heel to the forefoot. The elliptical ripple outer surface is similar to that described above with respect to the heel portion 110 of insole 100. This configuration may provide optimal performance for energy return meant for sports. The base is made from polyurethane foam, the walls in the forefoot portion 1230 and heel portion 1210 are made of polyurethane gel, and the arch shell 1220 is made from polypropylene.

An example embodiment of the base of an insole for a man's foot may be a polyurethane foam molded to the following specifications: a density in the range of 4.3 to 5.3 pounds per foot cubed; uncompressed foam forefoot thickness of 5.5 mm±1 mm; uncompressed foam heel thickness of 15.5 mm±1 mm; density of 4.3-5.3 lbs/ft3; a tear strength of 5 lbs/in, and a compression set of 2.5%. The base may weigh 18.0 grams±3.0 grams, though the weight may be affected by the type of cover used. The base may have a hardness of 40-50 Shore OO, measured by placing the insole in a special jig and durometer measured on the fabric side with a mounted durometer gauge, recording the reading after 5 seconds. The base may vary in thickness along the various regions of the insole; however, the general thickness near the portion underlying the toes may be 1.5 mm±0.5 mm thick, the forefoot portion 130 may be 2.8 mm±0.5 mm thick, the arch portion 120 may be 4.1 mm±0.5 mm thick, and the heel portion 110 may be 10.0 mm±1.0 mm thick. The length of the example embodiment may be 194 mm±5.0 mm from the toe end to the heel end, and the width of the example embodiment may be 94.0 mm±3.0 mm from the medial to lateral sides.

Another embodiment of an insole for a man's foot may include a polyurethane foam base may have a hardness of 25-80 Shore OO, preferably 45-60 Shore OO, measured by placing the insole in a special jig and durometer measured on the fabric side with a mounted durometer gauge, recording the reading after 5 seconds. The base may vary in thickness along the various regions of the insole; however, the general thickness near the portion underlying the toes may be 3-7 mm and the heel portion 110 may be 5-10 mm thick. The insole length (measured at the centerline) may be 300-350 mm, the greatest width (measured perpendicular to the centerline) may be 90-110 mm.

FIGS. 13A-17B provide cushioning member performance metric data and comparisons to prior art designs. Measurements of the cushioning and support properties of cushioning members can be made using any suitable method. An example of a suitable method is a Compression Load Deflection (CLD) test, which determines the stress-strain characteristics of a material in compression. This test, derived from ASTM Test D3574-Test B1, B2, C, approved edition Nov. 10, 2001, is performed by compressing a measured material layer, then measuring the load required to compress said material to specified compressive strain increments (15%, 25%, 50%, etc). This is done using compression/tension testing equipment sold by Instron Corporation of Canton Mass. U.S.A.

Figure 13A:
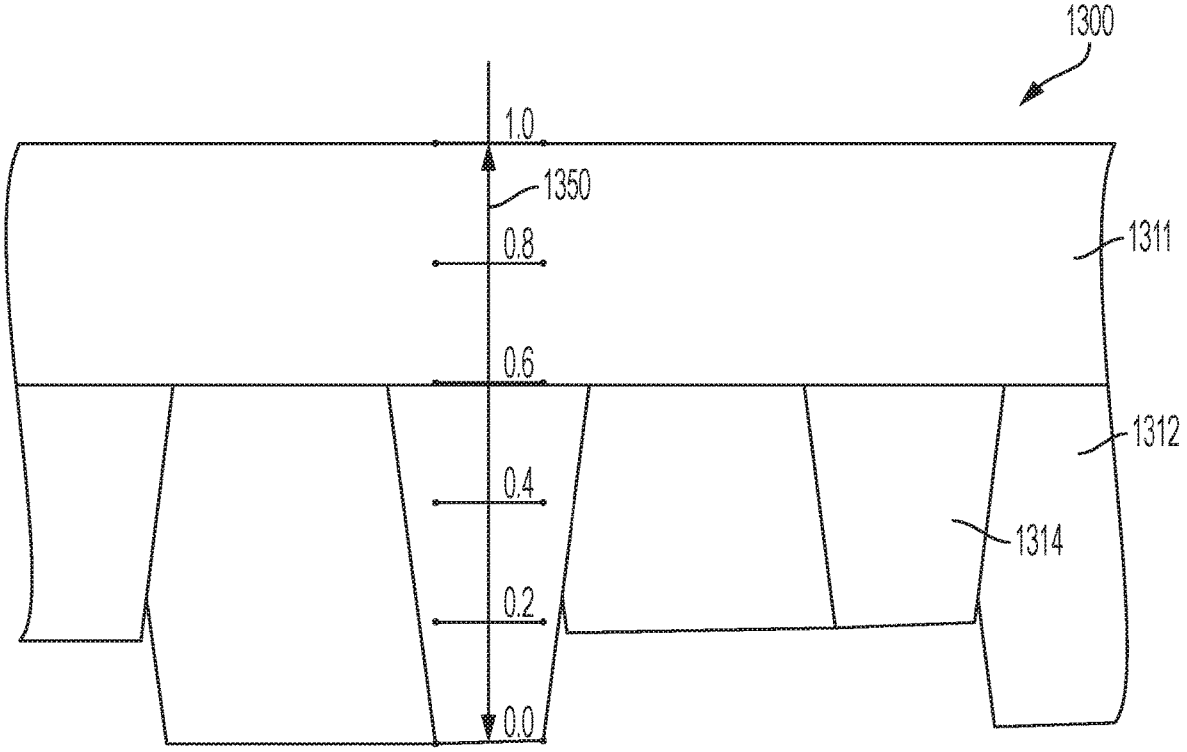
FIG. 13A is a cross section through a cushioning member, according to an embodiment, overlaid with a strain marker.
Figure 13B:
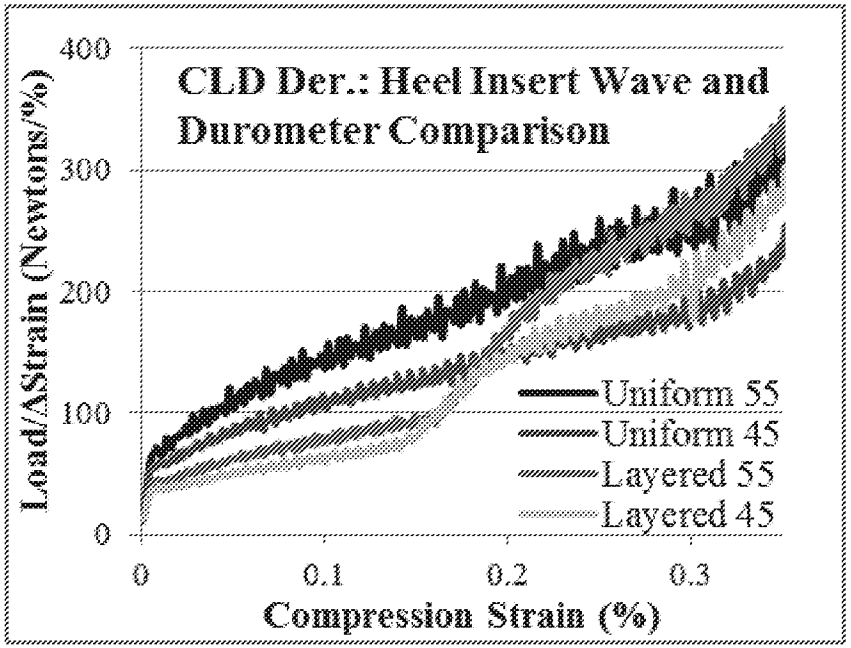
FIG. 13B is a chart showing the change in load/strain as a function of strain resulting from the compression load deflection testing of a cushioning member embodiment with curving walls of dual-height and 55 Shore OO hardness, a cushioning member embodiment with curving walls of dual-height and 45 Shore OO hardness, a similarly configured cushion having curving walls of even height and 55 Shore OO hardness, and a similarly configured cushion having curving walls of even height and 45 Shore OO hardness.

FIG. 13A depicts a cross section through a cushioning heel insert 1300 embodiment used to generate CLD test data shown in the graph of FIG. 13B. The cushioning heel insert 1300 includes dual height walls 1312, 1314 that extend from and sinusoidally along a base 1311. The relative heights of the taller walls 1312, shorter walls 1314, and base 1311 are indicated by the overlaid strain gauge 1350.

The graph of FIG. 13B provides the change in instantaneous elastic modulus (or ΔLoad/Strain) as a function of compressive strain. The data shown is the first derivative of the stress-strain curve resulting from the CLD test, which better illustrates points of inflection in the stress-strain trend. Four curves are provided, two for heel insert 1300 embodiments of different hardnesses—55 Shore OO ("Layered 55") and 45 Shore OO ("Layered 45")—and two for similarly configured inserts having walls of uniform height ("Flat 55" and "Flat 45").

As can be seen in the graph of FIG. 13B, the two heel insert 1300 embodiments have a lower instantaneous elastic modulus than the corresponding flat inserts below about 20% strain. The two heel insert 1300 embodiments have points of inflection in the range of 15% to 25%, which as shown in the cross section of FIG. 13A, corresponds to the deformation of the taller walls 1312 to the point that the shorter walls 1314 are engaged. For strains below these inflection points, the instantaneous elastic modulus for the insert 1300 embodiments is less than that of the corresponding flat test inserts, whereas for strains greater than about 20% strain the modulus is similar. This demonstrates that dual-height cushioning members can have greater cushioning at first, followed by comparable support at greater levels of compression.

The chart below provides the stress at 15%, 25%, and 50% strains for the test subjects of FIG. 13B. As can be seen in the chart, the layered heel insert 1300 embodiments require about half the stress than the flat test subjects at 15% strain but comparable stress at 50% strain.

| ~Stress at given Strains | 15% | 25% | 50% |
|---|---|---|---|
| Flat 55 | 4.44 | 9.00 | 38.03 |
| Flat 45 | 3.45 | 6.78 | 29.31 |
| Layered 55 | 2.58 | 6.24 | 33.12 |
| Layered 45 | 2.16 | 5.34 | 28.31 |

Figure 14A:
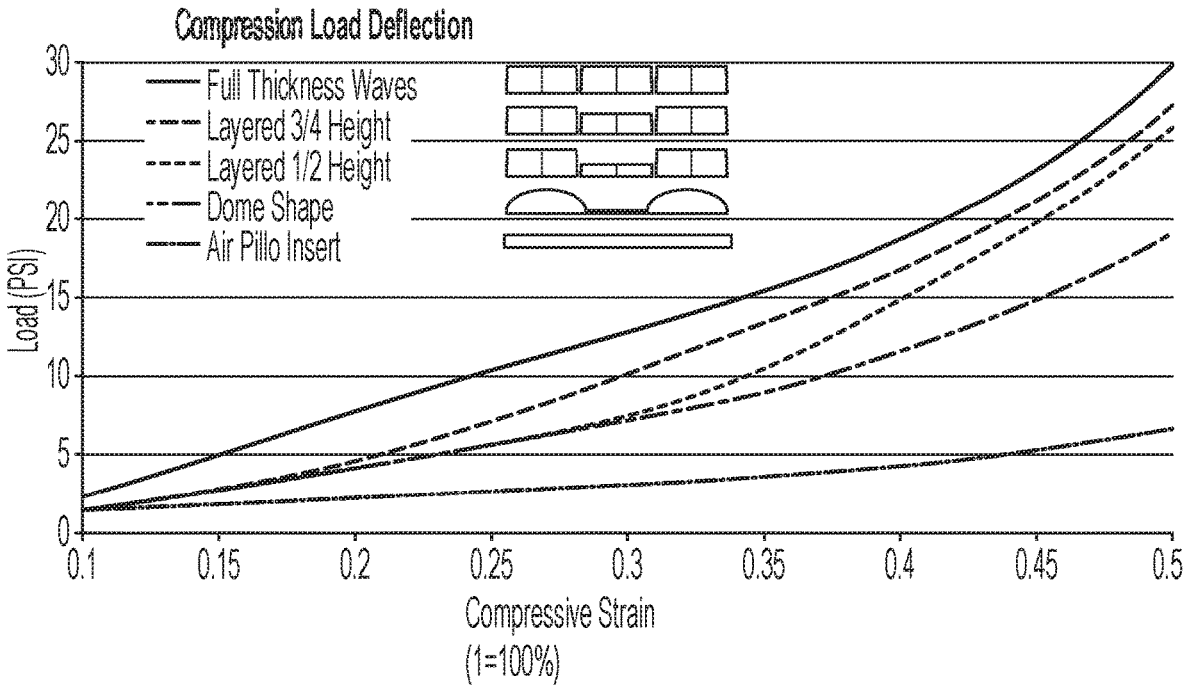
FIG. 14A is a chart showing the load as a function of stress resulting from the compression load deflection testing of: a cushion having curving walls of even height, a cushioning member embodiment with curving walls of dual-height in which the shorter walls are three-quarters of the height of the taller walls; a cushioning member embodiment with curving walls of dual-height in which the shorter walls are one-half of the height of the taller walls; a cushion having elongated dome-shaped walls of uniform height; and a cushion of uniform thickness with no protrusions.
Figure 14B:
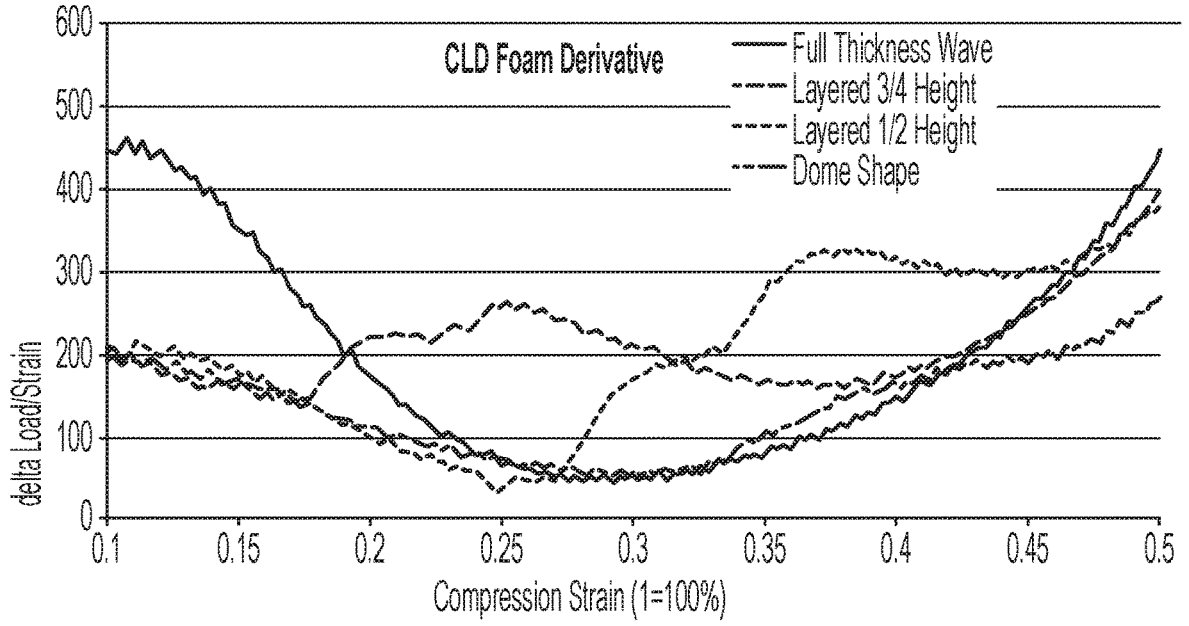
FIG. 14B is a chart showing the derivative of the data of the chart of FIG. 14A.

FIG. 14A provide CLD test data comparing dual-height wall embodiments ("Layered ¾ Height" and "Layered ½ Height") with a test specimen having flat-topped walls of uniform height ("Full Thickness Waves"), a test specimen having round-top walls of uniform height ("Dome Shape"), and a simple constant thickness piece ("Air Pillo Insert"). FIG. 14B provides the derivative of the data of FIG. 14A. All of the test specimens except for the "air pillow insert" included a base having a thickness of about 3.2 mm. The "Full Thickness Waves," "Layered ¾ Height," and "Layered ½ Height," each include walls extending from and curving sinusoidally along the base, similar to cushioning member 10 of FIG. 1. The walls of the "Full Thickness Waves" test specimen do not have variable height—all walls have the same 3 mm height. The "Layered ¾ Height" test specimen had taller walls of 3 mm in height and shorter walls of 2.25 mm in height. The "Layered ½ Height" test specimen had taller walls of 3 mm in height and shorter walls of 1.5 mm in height. The "Dome Shape" test specimen had rounded walls of 2.5 mm in height. The "air pillo insert" had uniform thickness of about 3.5 mm. All of the test specimens except for the "air pillo insert" were made of polyurethane foam. The "air pillo insert" was made of mechanically frothed latex foam. The tests referenced above were performed on polyurethane foam.

As can be seen in the elastic modulus change data shown in FIG. 14B, the "layered" embodiment curves each have an inflection point that corresponds to the transition from the taller walls to the shorter walls. The inflection point of the Layered ¾ Height is at a lower strain than that of the Layered ½ Height as would be expected. This graph shows that the compression point at which more cushioning transitions to more support can be tuned by configuring relative heights of walls or other protrusions, according to some embodiments. The stress-strain curve of FIG. 14A shows that the cushioning members exhibit initial stress-strain characteristics that are similar to the "Dome Shape" test specimen and trend toward stress-strain characteristics that are similar to the more supportive and resilient "Full Thickness Waves" test specimen.

Figure 15:
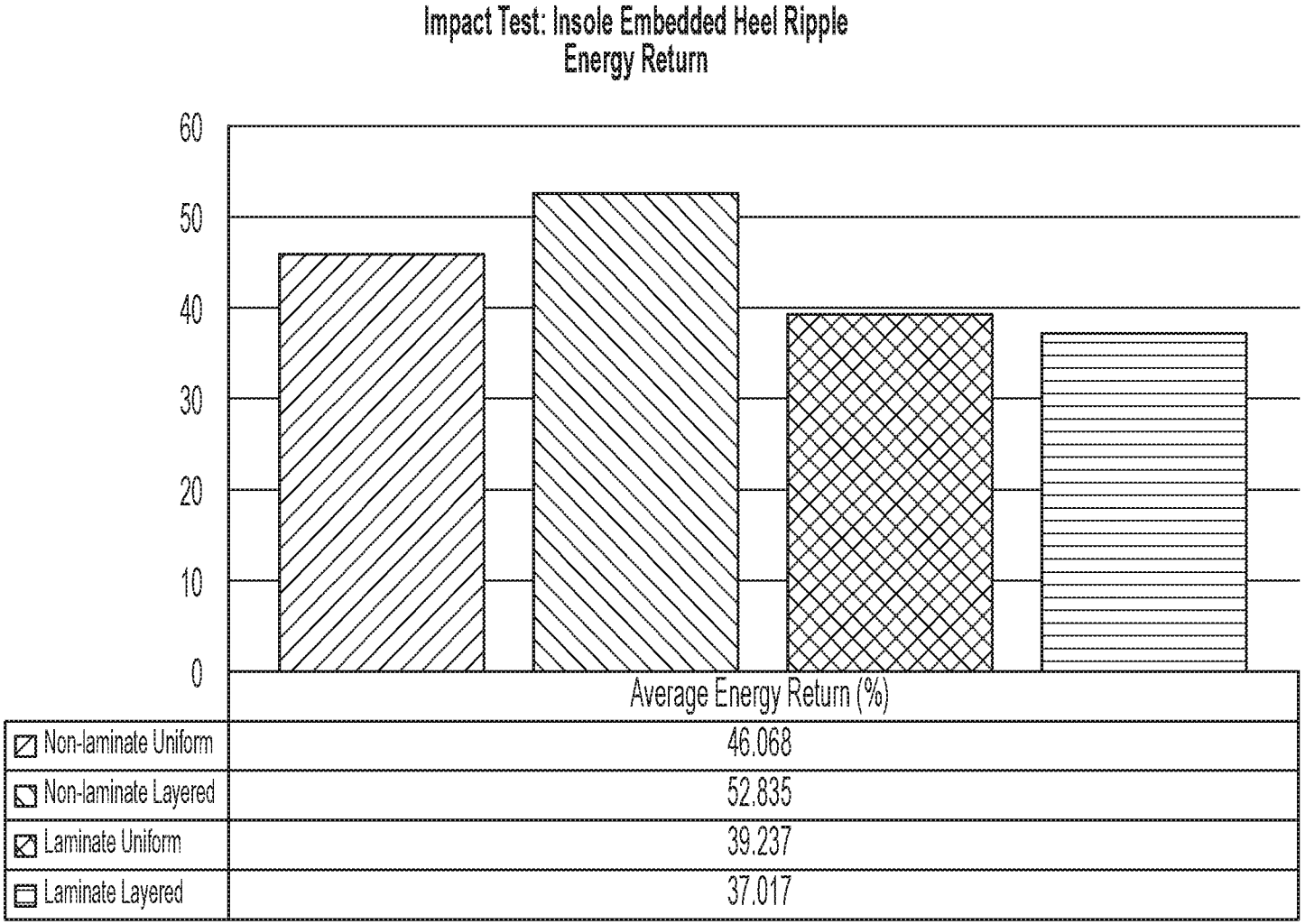
FIG. 15 is a chart comparing the energy return of: a heel portion of an insole having elongated dome-shaped SEBS gel walls of uniform height extending from a SEBS gel base, a heel portion of an insole embodiment having an elliptical ripple outer surface formed by distal ends of SEBS gel curving walls extending from a SEBS gel base; a heel portion of an insole having elongated dome-shaped polyurethane gel walls of uniform height extending from a polyurethane foam base, a heel portion of an insole embodiment having an elliptical ripple outer surface formed by distal ends of polyurethane gel curving walls extending from a polyurethane foam base.

FIG. 15 is a chart of energy return measured during an impact test. This test is described in SATRA PM 142-Falling Mass Shock Absorption Test. This was done using testing equipment purpose made for this test and sold by Exeter Research of Brentwood, N.H. U.S.A. As the name implies, a measure mass is dropped from a measured height onto the desired testing material. The acceleration/deceleration, distance traveled, and force are used to calculate metrics for energy rebound. The impact test was performed on heel portions of two insole embodiments ("Non-Laminate Layered" and "Laminate Layered") and heel portions of two comparison insoles ("Non-Laminate Uniform" and "Laminate Uniform"). The heel portions of the two insole embodiments were configured similarly to heel portion 110 of insole 100 of FIG. 2 and heel portion 1110 of insole 1100 of FIG. 11 (i.e., sinusoidal walls forming an elliptical ripple outer surface). The walls and base of the "Non-Laminate Layered" embodiment were made of SEBS gel. The base of the "Laminate Layered" embodiment was made of polyurethane foam and the walls were made of polyurethane gel. The heel portions of the "Uniform" comparison insoles included rows of round-topped walls extending from a base. The heel portion of the "Non-Laminate Uniform" was made of SEBS gel and the heel portion of the "Laminate Uniform" was made from polyurethane gel walls extending from a polyurethane foam base.

Whereas more energy rebound may be often desired in an insole or other cushioning application, this may not always be the case. Added energy rebound and material resilience would be most appropriate for the basic insole ("base") in which the user is constantly walking and looking for higher performance of their insoles for their daily routine. Insole purposed for users on their feet all day ("work") would often rather trade this added material resilience for an increase in comfort and cushioning. For these users, comfort is paramount to reduce foot fatigue at the end of the work day. The shift from more resilient material responses to more cushioning and comfort is not a tradeoff, as much as it is finely balancing the mechanical properties of the insole for the purpose of its intended application. In this sense, the "Base New" and the "Work New" have had their designs changed with the implementation of these tuned cushioning to provide more optimal insole performance for their respective application.

FIG. 16A-B and FIG. 17A-B provides cushioning energy test data for cushioning member embodiments and comparison test specimens. The cushioning energy test is an example of a test for measuring the shock-absorbing or cushioning properties of a cushioning member and is described in "Physical Test Method PM159—Cushioning Properties," SATRA, June, 1992, pages 1-7. Conducted using compression/tension testing equipment, sold by Instron Corporation of Canton Mass. U.S.A., this test is used to determine cushion energy (CE), cushion factor (CF) and resistance to dynamic compression. Cushion energy is the energy required to gradually compress a specimen of the material up to a standard pressure with a tensile testing machine. Cushion factor is a bulk material property and is assessed using a test specimen greater than sixteen millimeters thick. The pressure on the surface of the test specimen at a predefined loading is multiplied by the volume of the test specimen under no load. This pressure is then divided by the cushion energy of the specimen at the predefined load. Lastly, the resistance to dynamic compression measures changes in dimensions and in cushion energy after a prolonged period of dynamic compression. Different regimes of cushioning energy are defined—walking and running. Walking cushioning energy is determined from data generated during lower testing loading and running cushioning energy is determined from data generated during higher testing loading.

Figure 16A:
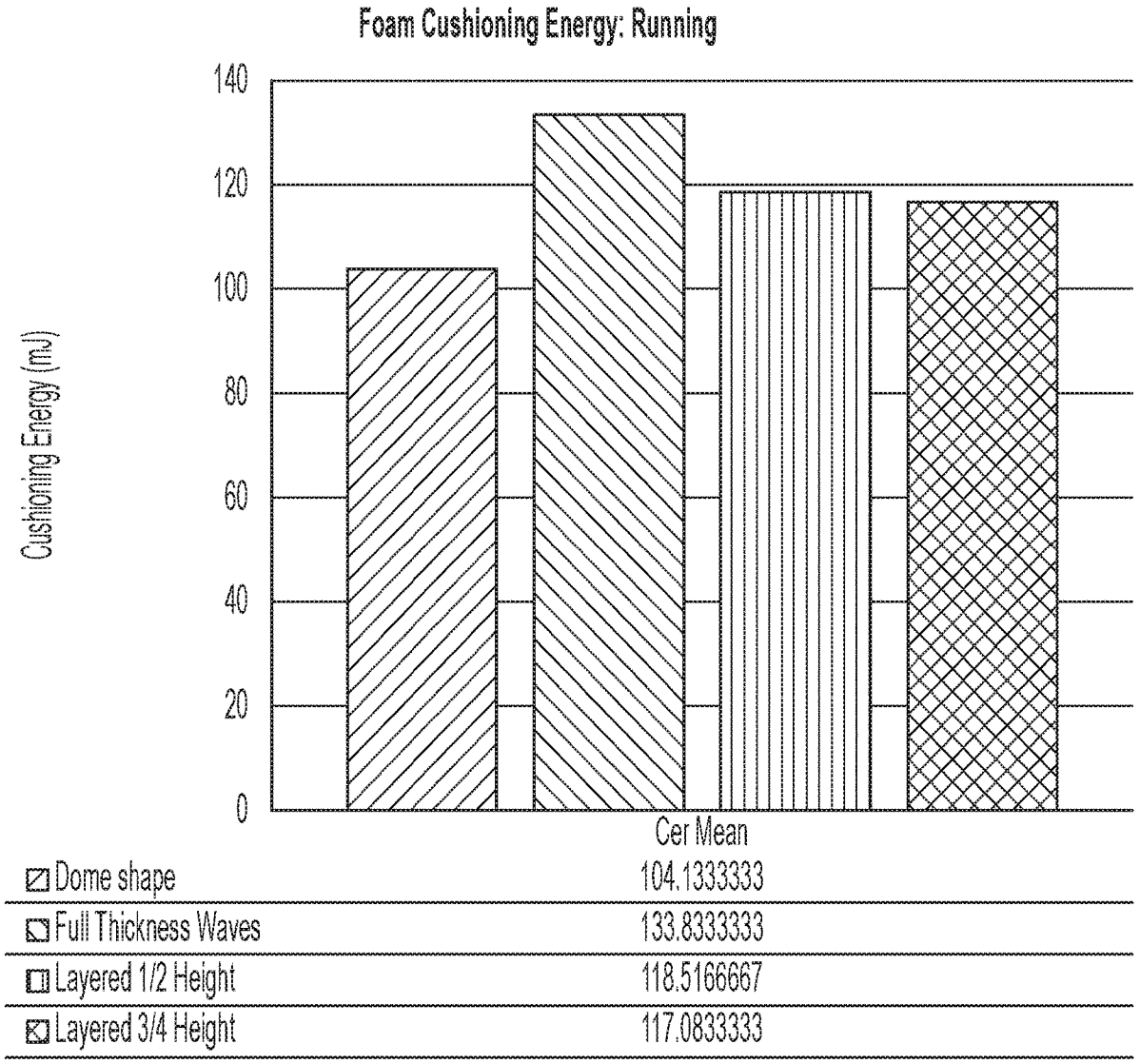
FIGS. 16A and 16B are charts of the cushioning energy for running and walking, respectively, comparing: a polyurethane foam cushion having elongated dome-shaped walls of uniform height, a polyurethane foam cushion having curving walls of even height, a cushioning member embodiment with polyurethane foam curving walls of dual-height with the shorter walls being one-half the height of the taller walls, and a cushioning member embodiment with polyurethane foam curving walls of dual-height with the shorter walls being one-quarter the height of the taller walls.
Figure 16B:
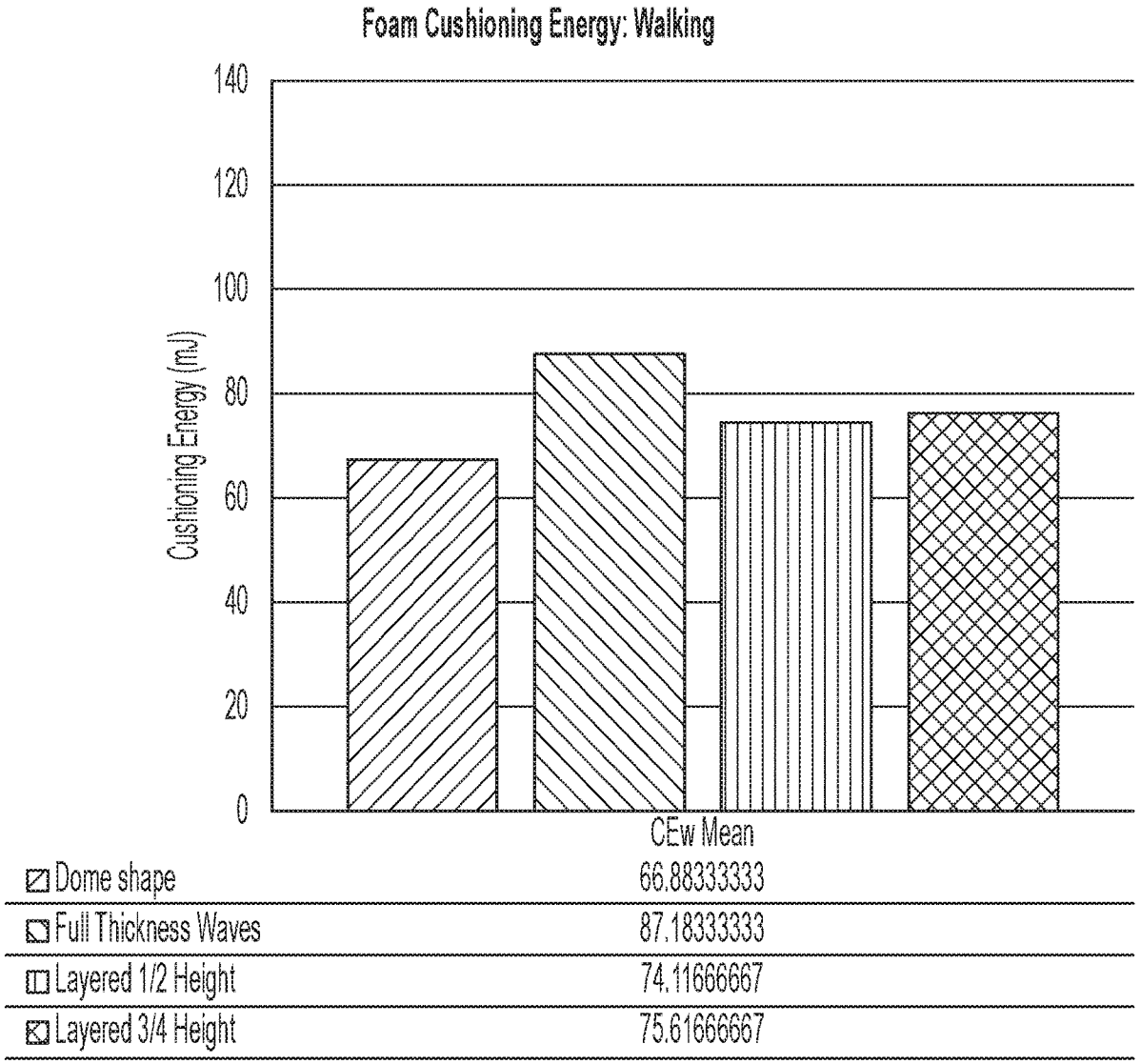

FIGS. 16A-B show the running and walking cushioning energy performance of two cushioning member embodiments ("Layered ½ Height" and "Layered ¾ Height") configured similarly to the forefoot region 130 of insole 100 of FIG. 2 in comparison with two test specimen of similar size ("Dome Shaped" and "Full Thickness Waves"). All of the test subjects were made of polyurethane foam. As illustrated, the running and walking cushioning energies for the cushioning member embodiments is between those of the Dome Shaped and Full Thickness Waves test specimens of similar size, illustrating that the performance of the cushioning member embodiments can be tuned through the configuration of the walls.

Figure 17A:
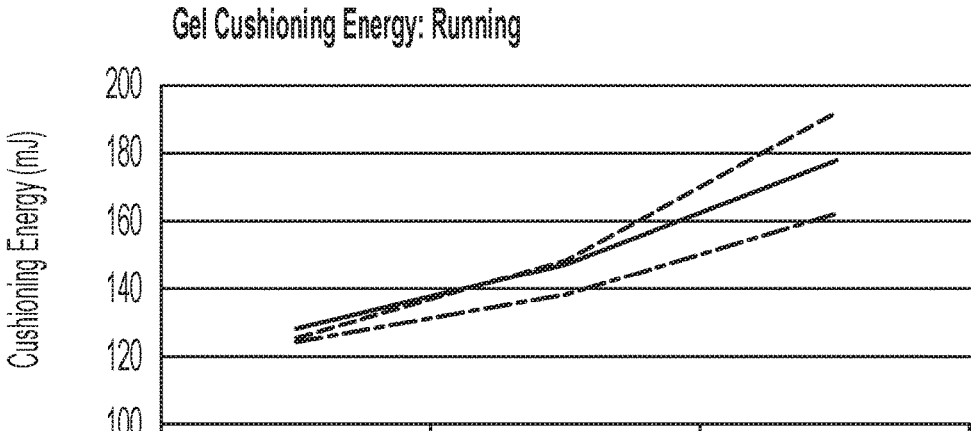
FIGS. 17A and 17B are charts of the cushioning energy for running and walking, respectively, comparing: cushions having elongated dome-shaped walls of uniform height and 30, 45, and 60 Shore OO hardness, similarly configured cushions having thinner walls and denser wave pattern, and cushioning member embodiments with curving walls of dual-height and 30, 45, and 60 Shore OO hardness.
Figure 17B:
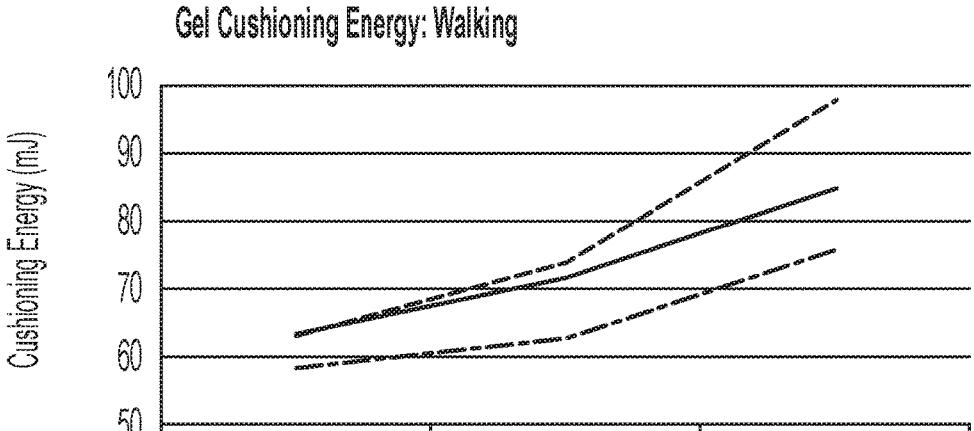

FIGS. 17A-B show running and walking cushioning energy comparisons between cushioning member embodiments having three different hardness and two configurations of comparison cushions of similar size and similar hardnesses. The "Full Thickness Wave" test specimen was 5.5 mm thick with walls of uniform height that extended from and curved sinusoidally along a base with a height above the base of about 3 mm. The base of the walls in the "Full Thickness Wave" specimen was 2.5 mm thick. The "Full Thickness Thin Dense Wave" test specimen was the same as the "Full Thickness Wave" test specimen but with a wall base thickness of about 1.5 mm and increased waves density. The "Layered Wave" cushioning member embodiment was similar to cushioning member 10 of FIG. 1 and was 7.5 mm thick in total (base plus walls) and had a taller wall height of 5 mm, a shorter wall height of 3 mm, and a thickness of the base of the walls of 2.5 mm. The test specimens were all made from SEBS gel. Three gel hardnesses were tested for each configuration—30 Shore OO, 45 Shore OO, and 60 Shore OO.

As illustrated in FIG. 17A-17B, the samples' cushioning energy differs depending on changes in both the wave geometries and materials. This illustrates the ability tune the durometer of the gel and its protruding structures in coordination for a specified mechanical response such as more or less cushioning energy depending on its desired application. Additionally, this highlights the broadening of applicable material durometers capable of being used to achieve a desired level of cushioning energy.

Consumer testing was conducted with an insole embodiment similar to insole 100 of FIG. 2, an insole embodiment similar to insole 1100 of FIG. 11, and two prior art insoles, of comparable respective configurations and materials but lacking the variable height walls, for comparison. A visual analogue scale (VAS) was used to measure consumer comfort. The results showed that the level of comfort for the insole embodiments was greater than for the comparable prior art comparison insoles. As discussed above, the improvement in comfort can be due to the taller protrusions providing a more comfortable feel while not sacrificing support and resilience. In other words, the taller protrusions may provide a less resilient material response, being perceived as softer, while the coupled compression of both the taller and shorter protrusions may provide a more resilient material response. This multi-height protrusion technology can provide both the perception of softer, comfier cushioning, for example, during standing and sitting, while still maintaining the resilience needed for mechanical performance under higher load scenarios, such as walking and running.

As discussed above, cushioning members (e.g., insoles, floor mats, etc.) can be tailored for a particular application by configuring the protrusions to provide the right balance between cushioning, support, and resilience for the particular application. Protrusion configuration variables such as the shapes, sizes, relative heights, and materials, can be selected to achieve the ideal balance for the application. In some embodiments, the configuration variables can be selected from a design matrix that can indicate the optimal configuration of a cushioning member for a given application. The design matrix may incorporate or be based on correlations between changes in design parameters and changes in cushioning member performance. For example, with reference to the CLD data graphs (stress v. strain) discussed above, harder protrusion materials may move a given CLD curve up providing more resilience for a given strain, which may be better for applications with higher loads. The opposite effect may be achieved by reducing the hardness of the material. Different relative protrusion heights may shift the inflection point in a CLD curve (e.g., FIG. 13B) left or right (decreasing or increasing strains), resulting in a greater or lesser range of cushioning strains. Different outer surface geometries created by the varying height protrusions can result in different amounts of cushioning energy.

The effects of configuration changes on cushioning member performance can be built into an algorithmic approach for tailoring cushioning members to specific applications and/or specific individuals. Using a design matrix, such as discussed above, or other tool, a tailored insole could be selected for a particular consumer using parameters such as the consumer's weight and foot size and the consumer's desired application, such as everyday use, work (sitting and standing), or performance (running). For example, a consumer may provide information specific to their application, including information about their body (e.g., weight, foot size, foot shape, etc.) and activity type (e.g., every day, work, active, areas of foot pain, etc.) into a computer program, which may be running on a kiosk, a smartphone app, a website, etc., and the optimally configured cushioning member, such as an insole or foot mat, may be determined based on the consumer information. For instance, an insole with harder material (shifting the CLD curve upward) may be determined (e.g., based on a design matrix or other algorithm) for a heavier consumer as compared to a lighter consumer since the insole for the heavier consumer will experience higher loading for the same activity type. Thus, varied height protrusions, according to the principles discussed above, can enable cushioning members, such as insoles, to be tailored to meet particular consumers' needs.

According to some embodiments, modifying the structural material durometer of a cushioning member, such as an insole, is another level of control for the layered cushioning response. According to some embodiments, material hardness can be varied to accommodate the body weight (BW) of an intended user. Protrusion structures (e.g., wave structures, according to various embodiments) composed of harder materials can provide a higher level of support appropriate for heavier people. Contrastingly, softer wave structures may be better suited for lower weight persons. Weight variation can be balanced against a target shoe size to determine the distribution of pressure on the cushioning member.

According to some embodiments, the threshold where the cushioning response changes based on a transition from loading of taller protrusions to loading of the short protrusions in addition to the taller protrusions correlates to the interaction of body weight and the activity of the user. This transition is tuned to coordinate with body weight loading levels associated with activities, which will be referred to as the Body Weight Activity Factor (BWAF). For example, standing produces approximately 0.5 BW for each foot, while walking and running will produce loads of approximately 1 BW and 2-3 BW, respectively, for each foot. The BWAF of standing, walking, and running, then, can be 0.5, 1.0, and 2-3, respectively. By tuning the configurations of protrusions to respond to specific load thresholds, a customized cushioning profile can be provided that is unique to each user's weight, foot size, and desired activities.

According to some embodiments, a decision tree algorithm can be used to determine cushioning member parameters based on a user's unique biomechanical needs. A decision tree algorithm can include two layers of inputs split between demographics inputs of the user (e.g. Body Weight (BW) and shoe size (S)) and activity inputs (e.g. Desired Activities (A) and Number of Desired Activities (N)). These values can be interpreted against a design matrix to determine the appropriate corresponding cushioning protrusion structures. Protrusion structure configuration can be driven by the algorithm outputs of Wave Height (H), Wave Material (M), and Number of Cushioning Performance Regions (P).

To illustrate the tailoring of cushioning member parameters according to a decision tree algorithm, a 160 lb male requiring an insole for walking and running, could create the following input parameters for a decision tree: BW=160 lbs, Activities=Walking, Running, S=Men's Size 10.5 (US), Number of Activities=2. The customized cushioning for this individual could be a medium level cushion material as the average BW of the user is distributed over the average footprint surface area, as dictated by the shoe size. The BW and shoe size of the user can dictate the material for the system of cushioning protrusions, the wave heights can be determined by the activities of the user. A primary cushioning layer height (the taller protrusions, referred to herein as 1') appropriate for supporting loads during walking for a 160 lbs person could be output. The secondary cushioning structure layer height (the shorter protrusions, referred to herein as 2') could be designed to engage when the higher waves are compressed to the height of the (2') height. For example, 2' would be tuned to activate for running loads for the user. For reference, the walking and running BWAF values in this example can be 1 and 2-3 times BW.

Comparatively, the example of a 160 lbs women looking for an insole to stand and walk in could produce a different set of outputs from the example above. In this example, the parameters are as follows: BW=160 lbs: Activity=Standing, Walking; S=Women's Size 8.5 (US); Number of Activities=2. Although the weights of the users in both examples are the same, the woman's footprint is expected to be smaller. This would mean smaller area of distribution and higher peak loading, which may mean the need for a harder material than that of the first example. Desired activities of standing and walking could result in approximate BWAF values of 0.5 and 1, respectively. When comparing to the example above, both individual wave's height and the difference between wave heights (1' and 2') could be reduced due to the difference in each example's BWAF values. This user's optimal cushioning structures could have shorter waves relative to the example above, with relatively reduced difference in height between waves, while also being comprised of a harder material.

Decision tree algorithms, according to various embodiments, can use other biomechanical variables as inputs in addition to those discussed above, such as shoe size, shoe width, area of shoe footprint, pressure profiles, and comfort levels. Decision tree algorithms can provide as outputs other geometric variables than those discussed in the examples above, including wave thickness, spacing between waves, wave length, draft angle of waves, and wave height variation within a single structure. Inclusion of additional input and/or output variables can enable more granular control of the output wave's unique cushioning response with respect to each user's distinctive input data. Balancing geometric variables of the cushioning wave structures with the material hardness levels allows for control over performance and comfort. Through a decision tree algorithm, a user can be provided a cushioning member, such as an insole, with specific multi-layer cushioning parameters, unique to their given biomechanical and activity parameters.

Performance tests were performed on cushioning member test units to determine the relative performance of variable height protrusion configurations. The following is a description of the testing setup and the resulting performance data.

Design plaques were prepared having a variety of protrusion height and material combinations. The protrusions were configured as parallel waves, similar to the configuration shown in FIG. 1. The plaques were approximately 82 mm by 62 mm (3.2" by 2.4"). The upper and lower limits of the primary (i.e., taller) wave heights were matched to material thickness levels typically seen in insole heel and forefoot regions, which resulted in an upper and lower limit of 9 mm and 1 mm, respectively, for the taller wave heights.

Ratio factors for the height of the secondary (i.e., shorter) wave relative to the primary wave were determined based on their application in insoles. Based on initial consumer tests, secondary waves of less than half the height of the primary waves, according to the embodiment tested, were deemed uncomfortable, and therefore not viable as a cushioning structure to use in an insole. That being said, the cushioning values of secondary wave heights outside of this 0.5 to 1.0 height ratio factor can be extrapolated from the data achieved within the test matrix.

The plaques included a consistent base thickness of 2 mm. Plaques made of SEBS Gel and PU Foam had an approximate base thickness of 2.4 mm and 2.7 mm, respectively. The primary and secondary wave heights, and the estimated strain values for the SEBS Gel and PU Foam cushioning curve inflection points, are laid out in the Tables 1a, 1b, and 1c, below.

TABLE 1a

| Matrix of Primary Wave and Secondary Wave heights, as calculated by the listed ratio. Varied plaque bases not included. | | |
|---|---|---|
| 1' wave 9 mm | 4.5 mm | 9.0 mm |
| 1' wave 1 mm | 0.5 mm | 1.0 mm |
| height ratio % to 1' | 0.5 | 1.0 |

TABLE 1b

| Estimated Strain Values of 2' wave height w.r.t single sample thickness of SEBS Gel | | |
|---|---|---|
| 1' wave 9 mm | 39.5% | 0.0% |
| 1' wave 1 mm | 14.7% | 0.0% |
| height ratio % to 1' | 0.5 | 1 |

TABLE 1c

| Estimated Strain Values of 2' wave height w.r.t single sample thickness of PU Foam | | |
|---|---|---|
| 1' wave 9 mm | 38.5% | 0.0% |
| 1' wave 1 mm | 13.5% | 0.0% |
| height ratio % to 1' | 0.5 | 1 |

The calculations of Table 1a show a matrix of primary wave heights against secondary wave heights as determined from the height ratio factors of 0.5 and 1. Tables 1b and 1c represent the strain value in which the loading transitions between cushioning layers occur for SEBS Gel and PU Foam, respectively. These values are derived using the respective base thicknesses for SEBS Gel and PU Foam, by normalizing the height of the secondary wave and the base thickness to the total wave height of the primary wave and the same base thickness. Table 1b and 1c values match to the respective Table 1a values, such that a primary and secondary wave set of 9 mm and 4.5 mm, respectively, should see a material response increase at approximately 39.5% strain for SEBS gel and 38.5% strain for PU Foam. Plaques were tested with SEBS gel and PU Foam of 40 shore OO and 70 shore OO hardness levels. These materials hardness levels were chosen since they are a good representation of the base materials and hardness levels commonly used in insoles today. With this setup, the upper and lower limits of the configurations (including wave heights and material hardness levels) and a middle point can be established to aid in interpolating other portions of the design matrix. Through this, the impact of wave height and material change on final cushioning properties can be established and applied through a design tree algorithm for use in a cushioning member such as an insole.

Performance was evaluated using an Adjusted CLD test. The Adjusted CLD test is based off of the traditional Compression Load Deflection Test described above. Samples were measured at single layer thickness to ensure maximum clarity in layered cushioning response. The test is adjusted to the format of a hysteresis loop to measure the cushioning response to loading and unloading. Determining cushioning response to loading and unloading provides key insight for development of cushioning, which can provide a user customized cushioning for when they are transitioning from a lower loading activity to a higher loading activity as well as the opposite of when they are transition from a higher loading activity to a lower loading activity. For example, the tuned cushioning response for a user who wants a walking and running insole can provide custom cushioning for when they transition from walking into running and when they transition back from running into walking. Once quantified, this cushioning response to design matrix relationship can establish a capability for tuning a set of cushioning structures in an insole to response to a user's unique set of desired activities.

Figure 18A:
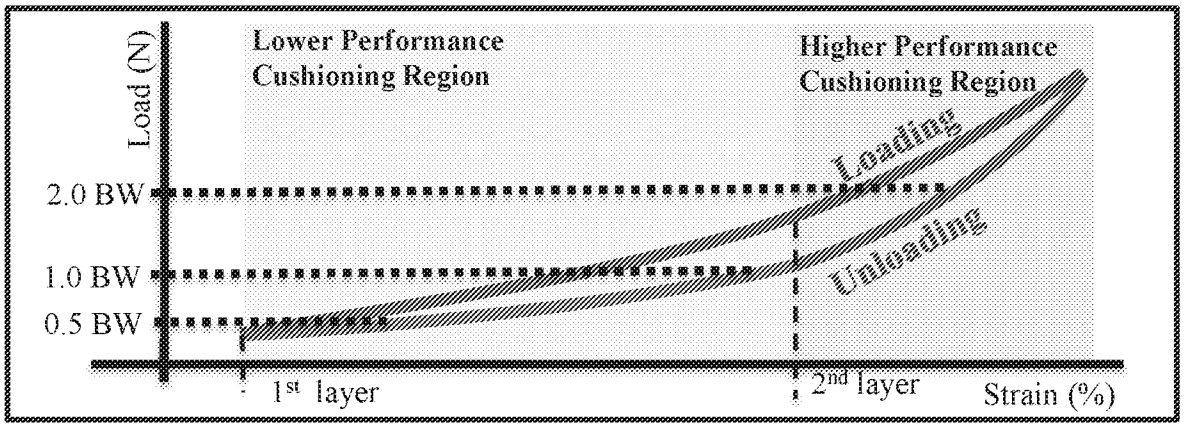
FIGS. 18A and 18B illustrate an Adjusted CLD curve and its derivative curve that show loading and unloading hysteresis, according to some embodiments.
Figure 18B:
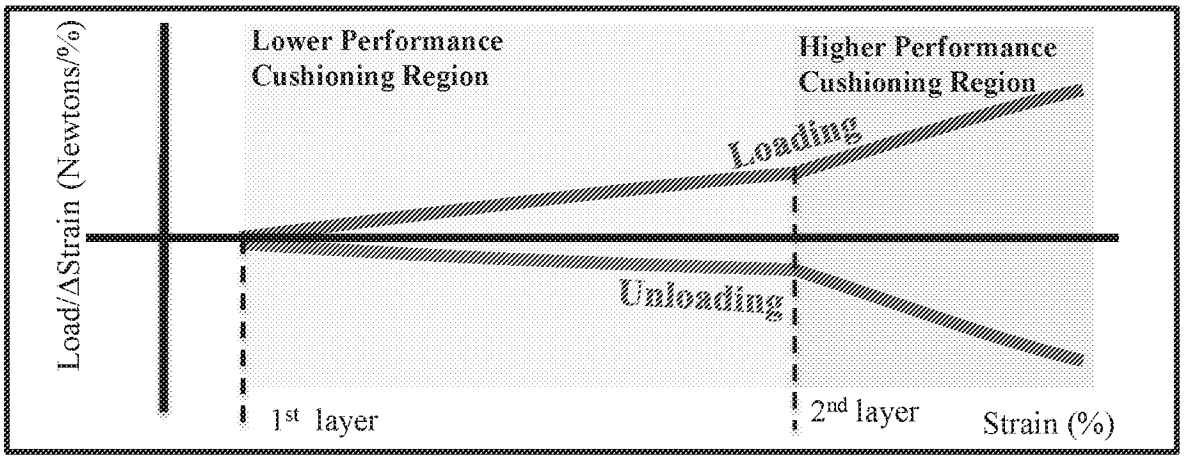

The Adjusted CLD test is illustrated in FIG. 18A, which shows loading and unloading response of multi-height cushioning waves, according to an exemplary embodiment. Included in the Adjusted CLD is the applied-loading levels of the average 180 lbs male for three key reference activities of Standing, Walking, and Running Similar to using the CLD Derivative, described above, for more granular analysis of the CLD curves, an Adjusted CLD Derivative can be used for visual analysis of key inflection points. The path of a hysteresis curve is correlated with positive incremental steps for the loading curve and negative steps for the unloading curve. This explains the trumpet shape and opposing slopes of the loading and unloading curve seen in FIG. 18B. Cushioning Performance Regions are highlighted and named according to the number of cushioning structure layers. Whereas the initial cushion provided solely by the tallest set of waves is labeled as the 'lower performance cushioning region", each subsequent layers' activation can be designated as a "higher performance cushioning region". FIGS. 18A and 18B illustrate the two regions that can occur with 2 layers of cushioning waves. Each additional layer of cushioning can produce an additional corresponding Cushioning Performance Region with higher performance metrics than its predecessor regions.

Measured results of Durometer testing (ASTM D2240) for plaques described above with respect to Table 1 are provided below in Table 2. Slight differences were found between the target and measured material durometer values (Shore OO) of the various gel and foam plaques. Such variations are taken into account when calculating the load strain relation from the Adjusted CLD measurements described below.

TABLE 2

| Plaque Durometer measurements | | | |
|---|---|---|---|
| Material | Requested | Measured | STDev |
| Low Gel | 40 | 42.75 | 2.72 |
| Med Gel | 55 | 56.94 | 3.38 |
| High Gel | 70 | 73.47 | 1.95 |
| Low Foam | 40 | 44.53 | 2.28 |
| Med Foam | 55 | 56.00 | 3.79 |
| High Foam | 70 | 67.83 | 8.11 |

Verification measurements of each test plaque's primary and secondary waves were recorded to determine any variability due to the sample production process. These were then compared against their respective estimated values, after taking into consideration the variation of base thicknesses due to materials and respective topcloth. Table 3 below presents this comparison, along with the standard deviation of the measured wave heights.

TABLE 3

Wave Height Verification Measurements For Each Plaque Design. Comparison of Estimated Values Against Measured Values And Their Standard Deviations

| | | [9, 9] | | [9, 4.5] | | [5, 0] | | [1, 1] | | [1, 0.5] | |
|---|---|---|---|---|---|---|---|---|---|---|---|
| | Design | Hi | Lo | Hi | Lo | Hi | Lo | Hi | Lo | Hi | Lo |
| Gel | Est. | 11.40 | 11.40 | 11.40 | 6.90 | 7.40 | 0.00 | 3.40 | 3.40 | 3.40 | 2.90 |
| | Meas | 10.83 | 10.83 | 10.73 | 6.46 | 6.95 | 0.00 | 3.01 | 3.01 | 3.21 | 2.75 |
| | STDev | 0.09 | 0.09 | 0.10 | 0.10 | 0.08 | 0.00 | 0.68 | 0.68 | 0.05 | 0.06 |
| Foam | Est. | 11.70 | 11.70 | 11.70 | 7.20 | 7.70 | 0.00 | 3.70 | 3.70 | 3.70 | 3.20 |
| | Meas. | 11.66 | 11.66 | 11.56 | 7.14 | 7.65 | 0.00 | 3.87 | 3.87 | 3.96 | 3.46 |
| | STDev | 0.11 | 0.11 | 0.07 | 0.06 | 0.13 | 0.00 | 0.11 | 0.11 | 0.07 | 0.09 |

Similar to the Durometer testing outcomes, there is some variability between the estimated and the measured values in Table 3. This can be attributed to a variety of factors, including inconsistencies in material flow rates during casting or injection molding, insufficient venting within plaque molds, and predominantly, softness of material creating difficulty in obtaining resolution from thickness measurement equipment. However, the variations are small and can be taken into account, just as the durometer tests results, when performing Adjusted CLD Test relationship calculations.

Figure 19A:
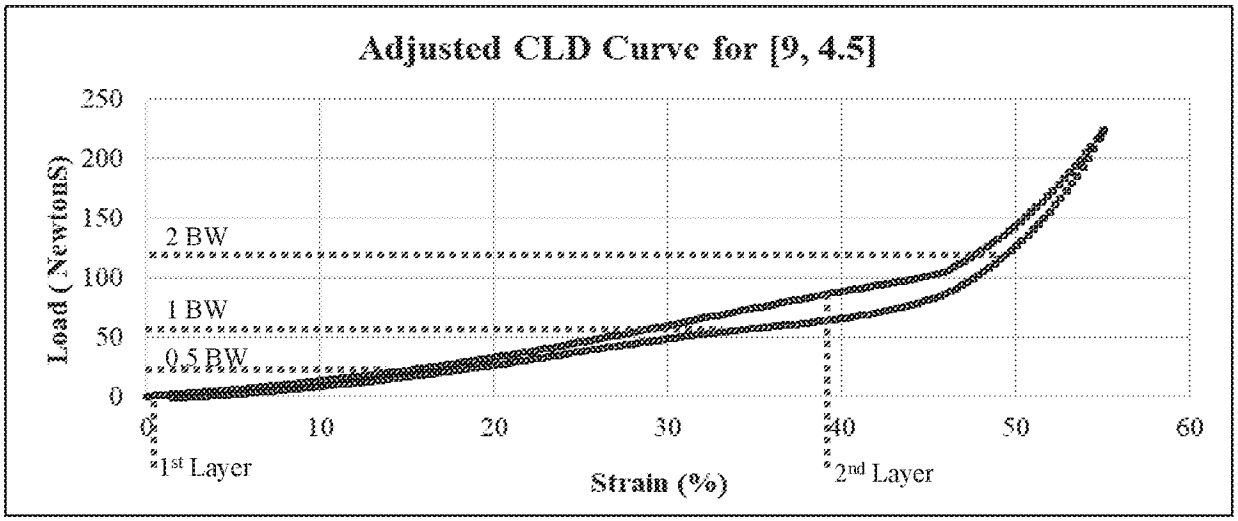
FIGS. 19A and 19B illustrate an Adjusted CLD curve and its derivative curve for a test plaque having configuration [9, 4.5], according to an embodiment.
Figure 19B:
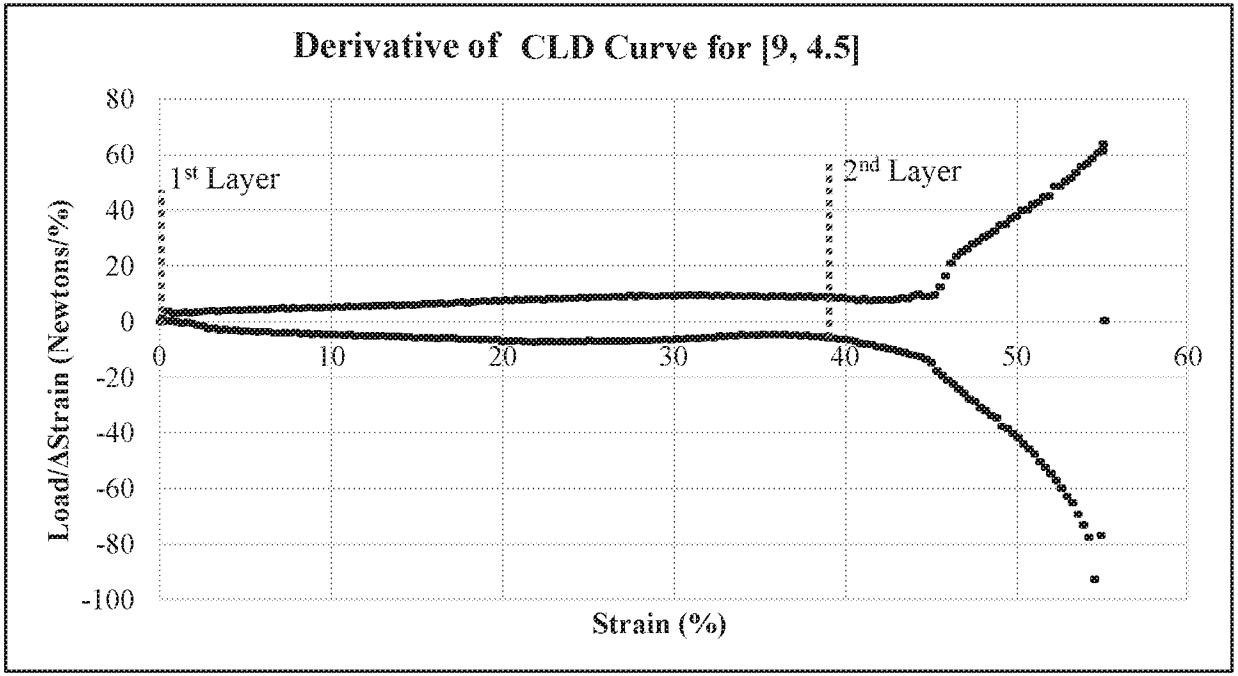

Output data from plaque design [9, 4.5] comprised of 70 shore OO SEBS Gel was used as a representative example of the layered cushioning response described in FIGS. 18A-B and exhibited by both [9, 4.5] and [1, 0.5] configurations. This plaque's Adjusted CLD curves and its respective derivative are illustrated in FIGS. 19A and 19B, respectively. Included in FIG. 19A are example loading reference lines for standing, walking, and running of a 180-lbs Male, as well as strain mark indicating cushioning layer heights with respect to strain.

From the graphs of FIGS. 19A and 19B, the inflection points for both the loading and unloading curve are determined to occur between the loading levels of walking (1 BWAF) and running (2 BWAF). This means cushioning structures derived from the [9, 4.5] configuration and comprised of 70 Shore OO could be optimal for 180 lbs male looking for an insole to use while walking and running. The slight displacement between the $2^{nd}$ layer and the visual kink of the curves in FIG. 19B may be due to the gradual buckling of the waves. An increase in the instantaneous Young's Modulus (ALoad/Strain) occurs near the strain point marked by "$2^{nd}$ layer" and gradually builds up in an exponential function to produce the full change in curve amplitude. The curve shapes and inflection points expressed by the [9, 4.5] configuration in FIG. 19A show are evidence for the principle for the underlying mechanism of the layered cushioning wave technology as described above according to some embodiments.

A key quantifiable takeaway from the testing data is that the inflection points created from the layered cushioning appears close at the estimated strain values of Table 1B, regardless of materials and/or material hardness, for the tested embodiments. Data for the average strain points is shown in Table 4 below.

TABLE 4

Comparison of inflection points estimated values and measured values

| | Gel 2.4 topcloth | | | Foam 2.7 topcloth | | |
|---|---|---|---|---|---|---|
| Plaque Design | Estimated | Measured | STDev | Estimated | Measured | STDev |
| [9, 4.5]: 9 mm w/4.5 mm waves | 39.47% | 39.78% | −3.9E−4 | 38.46% | 38.25% | 0.111 |
| [1,0.5]: 1 mm w/0.5 mm waves | 14.71% | 14.17% | −0.341 | 13.51% | 12.52% | −0.218 |

Comparison of the data within Table 4, shows that the Adjusted CLD Curve's inflection point, and thus the strain value for transitioning between Cushioning Response Regions, can be solely dependent on the geometric parameters of the structure and can be independent of material and/or material hardness. According to some embodiments, this establishes the relationship between structural design (i.e., protrusion heights) and the compressive strain values of the set of cushioning structures, which in turn can correspond to the unique cushioning responses. Such findings can indicate scalability, as the waves' overall heights can be scaled up (primary waves of 1 mm increased to 9 mm) with the inflection points for the system still being located at the estimated strain values. Scalability of the "layered" cushioning response can demonstrate applicability throughout a range of configurations and applicability outside of the tested lower and upper limits of 1 mm and 9 mm, respectively. Wave height measurements from Table 3 were utilized as normalization and reference factors during the testing and calculation phase of the Adjusted CLD Test. Using this information, as it is relative to each plaque sample design rather than to the design matrix, allows for more accurate analysis of loading and unloading values for each plaque design.

Figure 20:
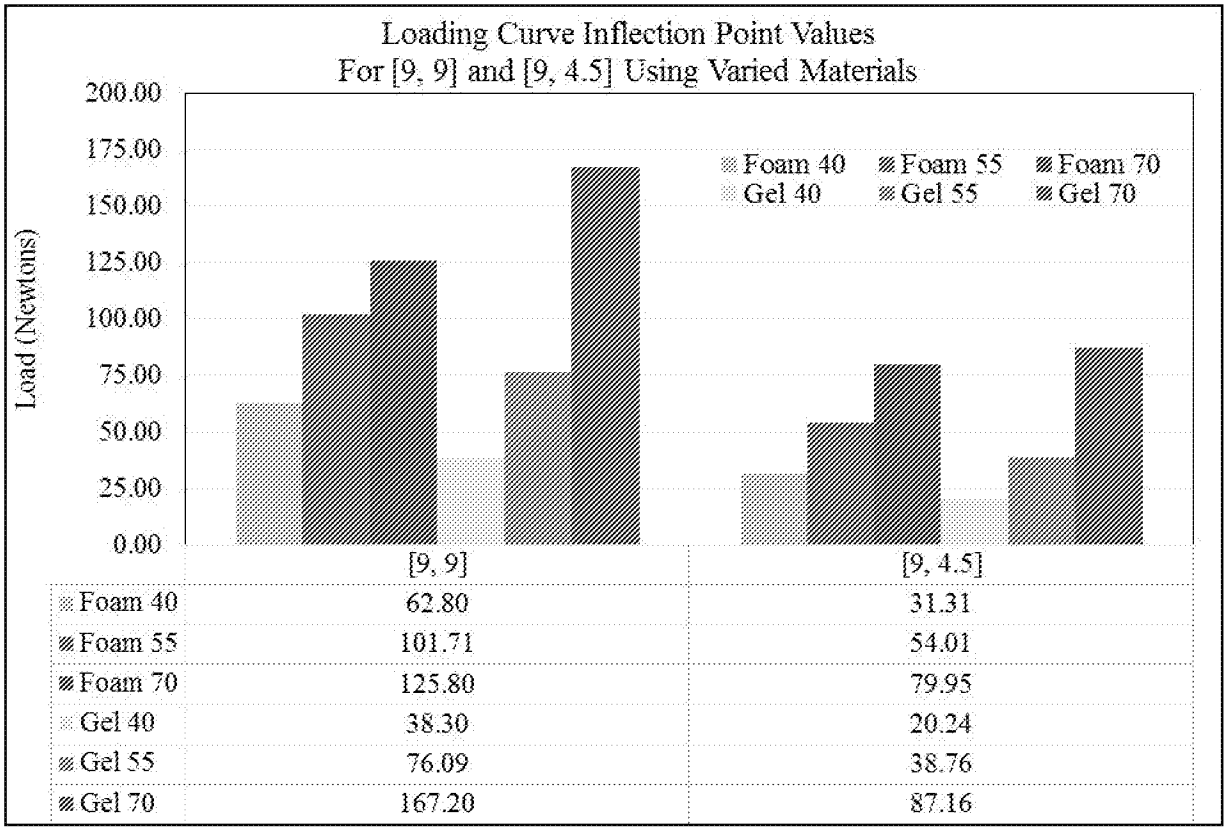
FIGS. 20 and 21 show loading and unloading curve inflection point values, according to some embodiments.

Although change in wave heights with respect to one another affects the inflection point strain value for the test plaques, this change affects loading and unloading inflection point amplitudes as well. This relationship is best illustrated by comparing the loading values for the loading curve inflection points of configurations [9, 9] and [9, 4.5], as seen in FIG. 20. Since configuration [9,9] does not have an inflection point, a point of reference is created on its curve at the same strain value of the configuration [9, 4.5] inflection point, 39.78% and 38.25% for gel and foam, respectively. The loading values in which this strain intersects the hysteresis loop of configuration [9, 9] are used for comparison.

Figure 21:
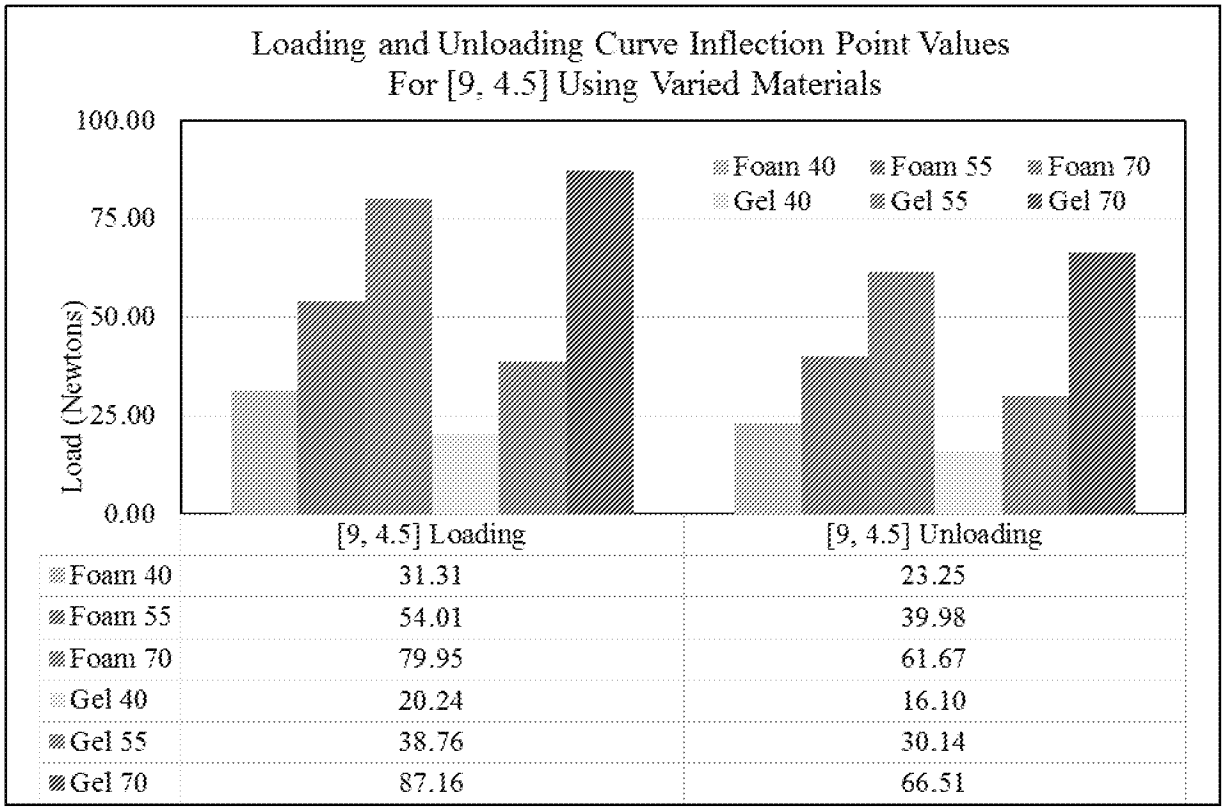

When comparing a set of waves with the second layer being half the taller layers height [9, 4.5] against its contemporary's design of uniform height waves (configuration [9,9]), it can be seen that approximately half the load is required to get to the transition point in which the lower cushioning waves begin bearing the applied load. This holds true for all materials tested, solidifying the idea that the wave heights can affect the transition points amplitude independent of the material being used, in some embodiments. With that in mind, material hardness and composition, impact the resultant cushioning curves' amplitude and inflection point's amplitudes, but not the inflection point's corresponding strain value. FIG. 21 compares the load values at the inflection points of both the loading and unloading curves for plaque configuration [9,4.5] spread over the six material types. A similar normalization technique previously used to reduced wave heights variability was applied here using the variability determined in the durometer measurements. The loading values are normalized and presented at their corresponding values as if they were at the initial estimated values of 40, 55, and 70 Shore OO. Material hardness levels are colored for 40, 55, and 70 Shore OO as yellow, blue, and red, respectively, while the foam uses a darker shade of these colors as compared to the gel graphed value bars.

A comparison of these data points leads to the conclusion that the load associated with inflection points of the same strain value can differ greatly or minimally, depending upon the material chosen, according to various embodiments. This is to say that the inflection point can be held steady and the material alone can be used to tune the cushioning response to coordinate with the desired BWAF thresholds. Manipulation of both wave heights and material of the waves can act as fine and course tuning mechanisms to output a desired mechanical response from a set cushioning wave structures.

According to some embodiments, the load value for the unloading curve's inflection points can be lower than that of the loading curve's load value at its inflection point. This is consistent with the basic principle of a hysteresis loop, which is to quantify the energy difference in a material's response when loading and unloading the material. To create customized cushioning meant for a user to use while transitioning from lower load activities to higher loads (walking to running), the inflection point of just the loading curve may be considered when manipulating the cushioning structures parameters. For customized cushioning to create the appropriate custom response when the user is transitioning from higher loading to lowering loading activities (running to walking), the inflection point of the unloading curve can be taken into account.

Figure 22:
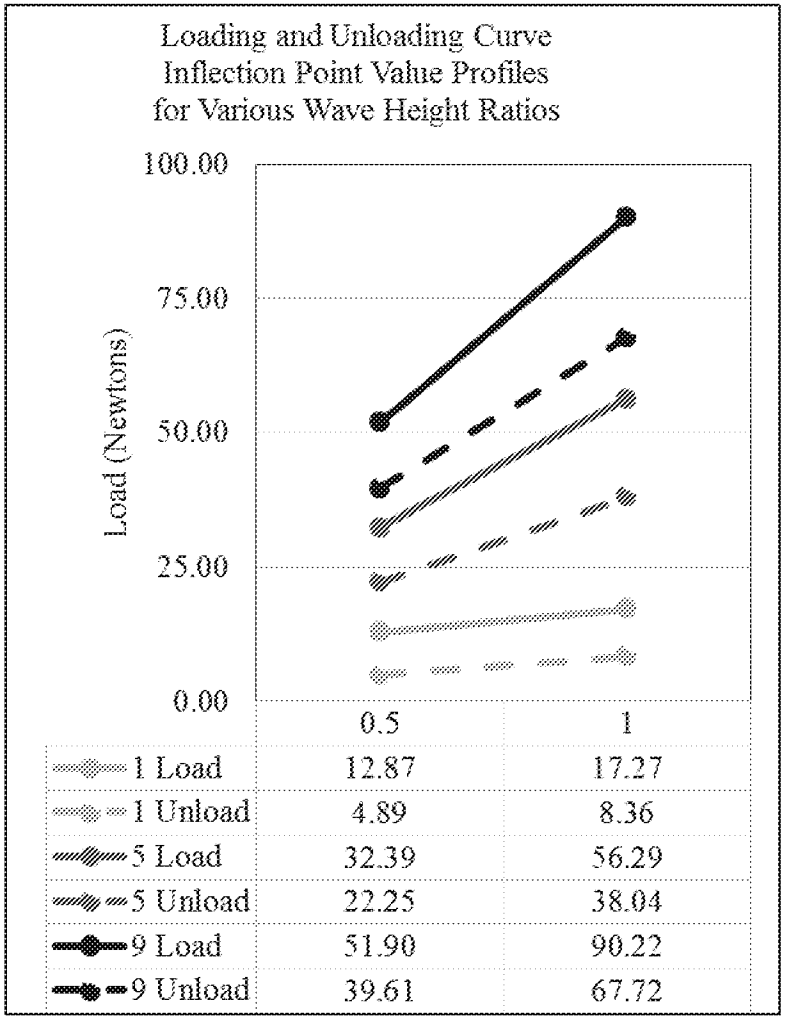
FIG. 22 shows loading and unloading curve inflection point value profiles for various wave height ratios, according to some embodiments.

By averaging each configuration's load values across durometers and analyzing the resultant load values at each design inflection, a relationship between varying the heights of the primary and secondary waves and their respective corresponding loads can be established. FIG. 22 illustrates this relationship for the calculated values of the inflections points on both the loading and unloading curves of test plaques. The values for configurations [5, 5] and [5, 2.5] were interpolated from the data collected from the corners of the design matrix in Table 1. FIG. 22 is laid out in a manner such that the "0.5" column value of configuration [9,9] represents the layered wave heights of 9 mm and 4.5 mm, whereas the "1" column of configuration [5,5] represents uniform height waves of 5 mm.

As can be seen in FIG. 22, certain values on these profiles overlap in loading ranges. For example, the loading curve value of a set of uniform 5 mm waves is greater than that of layered 9 mm and 4.5 mm waves. This shows that a combination of tuning materials and waves can be used to in a variety of arrangements to achieve a desired cushioning response output.

Figure 23:
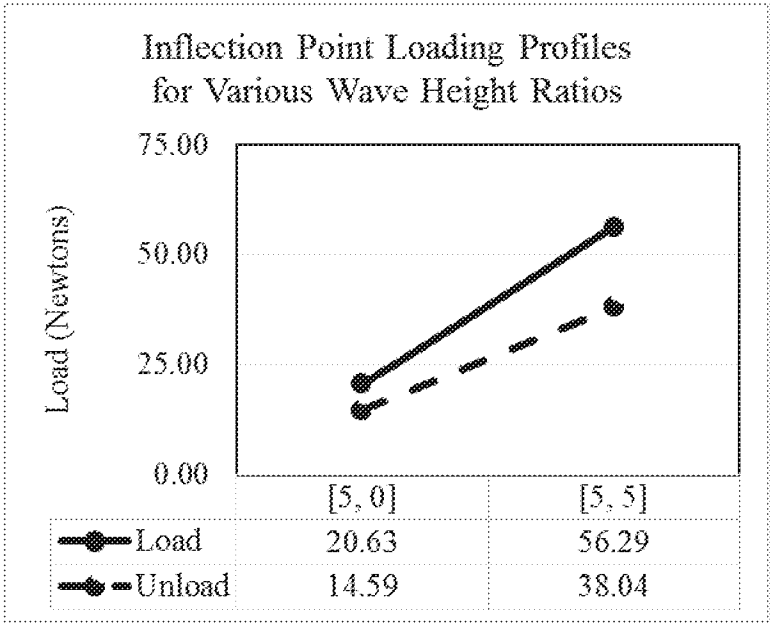
FIG. 23 provides a comparison of design plaques for analysis of wave spacing influence.

Configuration [5, 0], containing primary and secondary waves of 5 mm and 0 mm, respectively, was designed to exemplify the influence of introducing increased spaced between waves, according to some embodiments. This design represents a set of waves in which the distance between waves is set to be the thickness of the waves. FIG. 23 compares configuration [5, 0] against the interpolated value of 5 mm uniform height waves demonstrates that an increase in the spacing between waves would result in a reduction of the cushion profiles amplitude. The underlying principle for this relationship in the tested embodiment can be that there is simply less material to provide a cushioning response. With this principle in mind, is it concluded that an increase in wave spacing, and thus a decrease in material of wave per surface area, would also result in a decrease in the cushioning profile's amplitude, according to the tested configuration. According to some embodiments, increasing the draft angle of a cushion structure could produce a similar result as well. Contrastingly, increasing the wave's thickness, thusly increasing the material of a structure per surface area, could have the opposite effect and increase a curve's amplitude. These supplementary variables could be used to compensate for both performance and comfort levels. Harder, thicker waves could be applied for heavier set persons where more robust cushioning is needed to support the heavier loads. A lighter person with smaller feet may feel these waves more prominently under their feet and prefer thinner, tightly packed waves comprised of softer material.

Although analysis of additional layers of cushioning was excluded for brevity of testing and examples, the following underlying principal holds true: Increases in the number of desired activities will result in increase in the number of cushioning layers. A large number of activities with very similar BWAF values could result in loss of clarity as to inflection points and the creation of an inflection region on the Adjusted CLD Derivative Curve. Similarly, this inflection region would be produced from a set of cushioning structures whose individual structures contain variations in height. There may be instances in which a user's desired inputs produce cushion structures with these height parameters an inflection region responses. These instances may not have been outlined in the examples but rely on the same underlying layered cushioning principle as outlined above. The relationship between the input biometric and activity data and the output design parameters, according to the tested embodiments, is summarized in FIG. 24 and Table 5 below.

The inflection point of the loading profile for a set of cushioning layered cushioning waves can represent the point in which loading transitions from one wave onto the subsequent smaller waves. For unloading profiles, this inflection can represent the transition points and applied load transitions off a subsequent set of waves onto a taller set of waves. These inflection points can be manipulated through geometric parameters such as overall wave height and wave height with respect to one another, as well adjustment to wave material and hardness levels. By purposefully adjusting these variables so that this point is coordinated with the intersection of an activity loading level and the cushioning profile, a controlled, and thusly customized, cushioning response can be created from a set of wave structures.

TABLE 5

Figure 24:
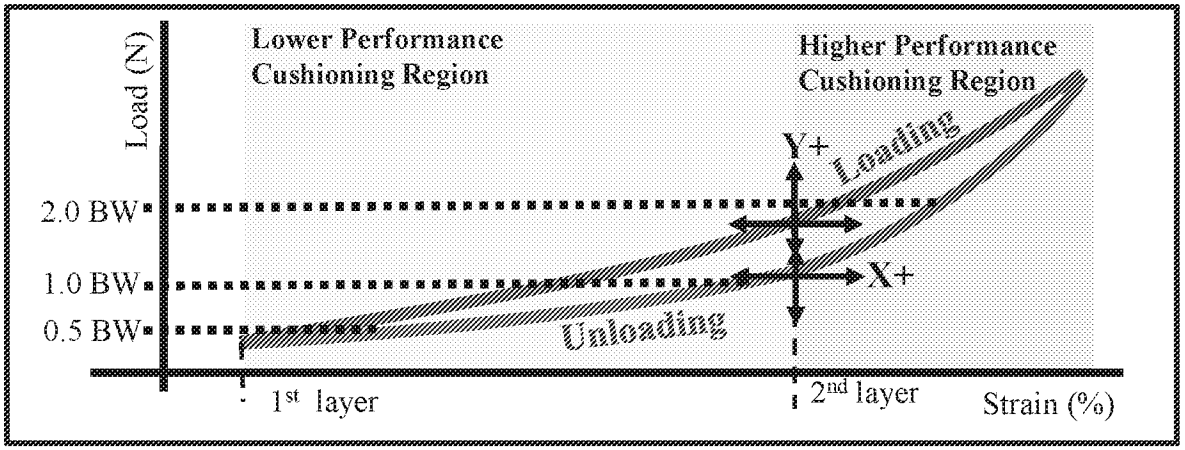
FIG. 24 shows in adjusted CLD curve, according to some embodiments.

| Overview of Input and Output relationship with Adjusted CLD Curve of FIG. 24 | |
|---|---|
| Inputs: | Outputs: |
| BW = Body Weight<br>S = Size (Men/Women)<br>A = Desired Activities<br>N = Number of Activities | H = Wave Height<br>M = Wave material<br>N = # of Cushion Performance Regions |

| Inputs | Relationship | Output |
|---|---|---|
| Body Weight | Positively affects total curve amplitude<br>Positively affects BWAF reference<br>Negatively affects curve amplitude | Positively affects M |
| Size (Gender) | Changes the approximate show insole surface area i.e. Men's sizes are larger than Women's can be expanded to include more granular forms of footprint measure | Negatively affect M |
| Desired Activities | Changes intersection point of loading level and Adjusted CLD curve.<br>Adjusts Inflection Points relative to BWAF reference | Positively affect H |
| # of Activities | Directly correlates to number of inflection points<br>Direct correlate to Cushion Performance Regions | Correlates to N |

Additional Variables

Wave Thickness
Positively matches increase in curve amplitude
Wave Spacing
Negatively matches increase in curve amplitude
Wave Length
Negatively matches increase in curve amplitude
Wave Draft Angle
Negatively matches increase in curve amplitude A clinical test for comfort and performance was evaluated in 184 subjects, approximately 92 Men and 92 Women with at least 30% per gender, per insole type completed this research testing. This multi-center study was conducted among men and women 25-65 years of age, who experienced foot and leg fatigue and foot discomfort at the end of their day while wearing dress, casual, work shoes or sneakers as part of their regular daily routine. Qualified subjects were persons that were on their feet during the day and that wore their shoes for eight hours per day over their normal work week. After 3 days of a minimum 8 hours daily wear, comfort and relief from foot and leg fatigue levels were recorded using a Likert scale (0 mm-100 mm) and 6-point Likert Scale, respectively. Measurements of these two points were taken at baseline (before use of the insole), Immediate (immediate use of the insole), and Day 3 (after 3 days use of the insole) time points. Additionally, subjects indicated whether they felt an increased level of softness localized in the forefoot area where the greatest amount of the Massaging Gel Advanced e.g. Layered cushioning waves) were found and where the perception of softness would be best perceived. This softness was measured using Likert scale range from 1 (no softness) thru 2 to 5 (increased degrees of softness). Results for the measures of comfort and relief, as well as the total percentage of positive softness responders are laid out in the Tables 6a-c below. While the Massaging Gel Advanced™ provided comfort and fatigue relief, it also provided an increased feeling of "softness" as compared to the Original Massaging Gel. Arguably, this feeling of "softness" is a result of this lower cushioning response region produced from only the taller waves being compressed at lower loading instances.

TABLE 6a

| Overall Foot Comfort Improvement - Visual Analog Scale (0-100 mm) | | | |
|---|---|---|---|
| | Baseline (no insole) | Immediate | Day 3 |
| Massaging Gel Advanced Insoles | 16.18 | 54.40 | 69.16 |

*Improvements in comfort at the immediate, day 1 and day 7 time points were highly statistically significant at $p < .0001$ TABLE 6b

| Relief from Foot and Leg Fatigue - 6 point Likert scale | | | |
|---|---|---|---|
| | Baseline (no insole) | Immediate | Day 3 |
| Massaging Gel Advanced Insoles | 3.86 | No fatigue measurement at this time point | 1.48 |

*Reductions in foot and leg fatigue at day 1 and day 3 were significantly lower than baseline at $p < .0001$ TABLE 6c

| Total percentage of positive responders for Softness in the forefoot against no insole | |
|---|---|
| | Softness in the Forefoot Day 3 |
| Original Massaging Gel Insoles | 86.76 |

TABLE 6c-continued

| Total percentage of positive responders for Softness in the forefoot against no insole | |
|---|---|
| | Softness in the Forefoot Day 3 |
| Massaging Gel Advanced Insoles | 97.48* |

*Increased levels of softness to the forefoot upon use of the Original Massaging Gel insoles and the Massaging Gel Advanced insole showed significant differences ($p < .01$). in favor of Massaging Gel Advanced insoles for subjects indicating increased levels of softness To evaluate overall performance, 92 subjects at one site were provided with the accelerometers for comparative assessment of total step counts over a three-day period with minimum eight hours of daily. Subjects using a Massaging Gel Advanced™ took up to 13.53% (p value<0.05) more steps than those that wore the Original Massaging Gel™ insoles. This is to say these subjects unknowingly increased the amount they stepped each day due to the improved mechanical properties of the Massaging Gel Advanced™ as compared to the Massaging Gel™. Additionally, the mechanical properties of the insole were evaluated to support this increased level of performance Impact test data (Satra Method PM142) showed an increase in Energy Return levels of up to 10%, (p value<0.0001) of the Massaging Gel Advanced as compared to the Original Massaging Gel. It should be noted that this increase in Energy Return occurred with no statistical difference in Shock Attenuating properties, meaning the cushioning structures provide more efficient cushioning performance for the user. This is to say that the implementation of new cushion structures, as derived through use of the design matrix and Decision Tree formulation, provided comfort and increased performance for the subject which is both validated per mechanical lab testing and perceivable per the subjective responses obtain in this study.

The foregoing description, for the purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims. Finally, the entire disclosure of the patents and publications referred to in this application are hereby incorporated herein by reference.

The invention claimed is:

1. A cushioning system, comprising:

a base member having a first recessed region and a second recessed region;

a first cushioning member formed from a plurality of protrusions in the form of walls extending from a first recessed region of the base, the plurality of protrusions comprising a first set of protrusions extending to a first height and a second set of protrusions extending to a second height, the first and the second set of protrusions configured in an alternating arrangement and forming a stepped outer surface;

a second cushioning member formed from a plurality of protrusions in the form of walls extending from a second recessed region, each protrusion varying in height across its length and width, wherein the height variations in adjacent portions of the plurality of protrusions collectively form an irregular outer surface in the form of an elliptical ripple; and an outer surface at least partially formed from the stepped outer surface of the cushioning member in the first recessed region and the irregular outer surface of the cushioning member in the second recessed region, the protrusions configured to deform to provide cushioning in response to a pressure applied by a planar surface in contact with the outer surface.

2. The cushioning system of claim 1, wherein the first and second protrusions are walls that extend along the base.

3. The cushioning system of claim 2, wherein the walls curve along the base.

4. The cushioning system of claim 1, wherein the walls curve sinusoidally along the portion of the base.

5. The cushioning system of claim 1, wherein a base of the first protrusion is spaced apart from a base of the second protrusion.

6. The cushioning system of claim 5, wherein the first and second protrusions are first and second walls and the base of the first wall is spaced apart from the base of the second wall along an entire length of the first wall.

7. The cushioning system of claim 1, wherein a height of the first protrusion varies along a length of the first protrusion.

8. The cushioning system of claim 1, wherein the entire first protrusion is taller than the entire second protrusion.

9. The cushioning system of claim 1, wherein at least the first protrusion is made from elastomeric gel or cellular foam.

10. The cushioning system of claim 1, wherein a first set of protrusions of the plurality of protrusions is taller than a second set of protrusions of the plurality of protrusions and each protrusion in the first set of protrusions is adjacent to a protrusion in the second set of protrusions.

11. The cushioning system of claim 10, wherein protrusion height alternates from one protrusion to the next.

12. The cushioning system of claim 1, wherein at least a portion of the outer surface has a rippled shape that is formed by the distal ends of the protrusions.

13. The cushioning system of claim 12, wherein the rippled shape is a sinusoidal shape.

14. The cushioning system of claim 1, wherein at least a portion of the outer surface has a stepped shape that is formed by the distal ends of the protrusions.

15. The cushioning system of claim 1, wherein at least a portion of the outer surface has a saw-tooth shape formed by the distal ends of the protrusions.

16. The cushioning system of claim 1, wherein a height of the portion of the first protrusion is greater than a depth of the recess.

17. The cushioning system of claim 1, wherein a height of the adjacent portion of the second protrusion is less that the depth of the recess.

* * * * *